US005747228A

United States Patent [19]

Bohan et al.

[11] Patent Number: 5,747,228

[45] Date of Patent: May 5, 1998

[54] METHOD FOR PROVIDING A COLOR DISPLAY IMAGE USING DUPLITIZED COLOR SILVER HALIDE PHOTOGRAPHIC ELEMENTS

[75] Inventors: Anne E. Bohan; John M. Buchanan; Richard P. Szajewski, all of Rochester, N.Y.

[73] Assignee: Eastman Kodak Company, Rochester, N.Y.

[21] Appl. No.: 834,591

[22] Filed: Apr. 7, 1997

[51] Int. Cl.[6] ..... G03C 7/407

[52] U.S. Cl. ..... 430/380; 430/359; 430/362; 430/391; 430/503; 430/963; 358/518; 358/527

[58] Field of Search ..... 430/359, 362, 430/380, 391, 503, 963

[56] References Cited

U.S. PATENT DOCUMENTS

| | | | |
|---|---|---|---|
| 4,049,454 | 9/1977 | Van Doorselaer et al. | 430/7 |
| 4,195,996 | 4/1980 | Nakajima et al. | 430/380 |
| 4,272,613 | 6/1981 | Shibaoka et al. | 430/364 |
| 4,284,714 | 8/1981 | Ogawa et al. | 430/364 |
| 4,362,795 | 12/1982 | Ogawa et al. | 430/9 |
| 4,500,619 | 2/1985 | Ishikawa et al. | 430/59 |
| 4,755,447 | 7/1988 | Kitts, Jr. | 430/139 |
| 4,865,958 | 9/1989 | Abbott et al. | 430/542 |
| 5,267,030 | 11/1993 | Giorgianni et al. | 358/527 |
| 5,344,750 | 9/1994 | Fujimoto et al. | 430/434 |
| 5,375,000 | 12/1994 | Ray | 430/506 |
| 5,380,636 | 1/1995 | Malfatto et al. | 430/503 |
| 5,455,146 | 10/1995 | Nishikawa et al. | 430/383 |

FOREIGN PATENT DOCUMENTS

| | | |
|---|---|---|
| 624028 | 11/1994 | European Pat. Off. . |
| 726493 | 8/1996 | European Pat. Off. . |

*Primary Examiner*—Hoa Van Le
*Attorney, Agent, or Firm*—J. Lanny Tucker

[57] ABSTRACT

A color corrected display image can be rapidly provided by color developing an imagewise exposed, duplitized color photographic element, scanning the developed image to form digital signals, and digitally manipulating those signals to correct either interimage interactions and/or gamma mismatches among at least two color recording units. The color corrected image can be provided in any desired form. The duplitized elements have at least one light-sensitive silver halide imaging layer on each side of the support.

37 Claims, 3 Drawing Sheets

METHOD FOR PROVIDING A COLOR DISPLAY IMAGE USING DUPLITIZED COLOR SILVER HALIDE PHOTOGRAPHIC ELEMENTS

RELATED APPLICATIONS

Copending and commonly assigned U.S. Ser. No. 08/834,557, filed on even date herewith by Buchanan, Bohan and Szajewski, and entitled "Method for Rapid Processing of Duplitized Color Silver Halide Photographic Elements".

Copending and commonly assigned U.S. Ser. No. 08/826,696, filed on even date herewith by Szajewski and House, and entitled "Duplitized Color Silver Halide Photographic Element Suitable For Use in Rapid Image Presentation".

Copending and commonly assigned U.S. Ser. No. 08/834,576, filed on even date herewith by Szajewski and House, and entitled "Film Spool Cartridge and Camera Containing Duplitized Color Silver Halide Photographic Element".

FIELD OF THE INVENTION

This invention relates to a method for presenting or providing a color display image using a duplitized, camera speed, light sensitive silver halide color photographic material. In particular, it relates to a method for photographic processing of an imagewise exposed, duplitized light sensitive material followed by digitizing and color optimizing the digitized image.

BACKGROUND OF THE INVENTION

Production of photographic color images from light sensitive materials historically consists of two processes. First, color images are generated by light exposure of camera speed light sensitive films (including color negative and color reversal films), that are sometimes called "originating" elements because the images are originated therein by the film user (that is, "picture taker"). These negative images are then used to generate positive images in light sensitive materials. These latter materials are sometimes known as "display" elements and the resulting images may be known as "prints" when coated on reflective supports or "films" when coated on non-reflective supports. Both originating and display color forming elements are generally prepared with all of the light sensitive layers on one side of a support so as to provide good sharpness. Typical layer orders are described in *The Theory of the Photographic Process*, 4th edition, T. H. James editor, Macmillan, New York 1977.

The imagewise exposed materials are processed in automated processing machines through several steps and processing solutions to provide the necessary display images. Traditionally, this service has required a day or more to provide the customer with the desired prints. In recent years, customers have wanted faster service, and in some locations, the time to deliver this service has been reduced to less than an hour. Reducing the processing time to within a few minutes is the ultimate desire in the industry.

To do this, each step of the process must be shortened. Reduction in processing time of the display elements or color photographic papers has been facilitated by a number of recent innovations, including the use of predominantly silver chloride emulsions in the elements, and various modifications in the processing solutions and conditions so that each processing step is shortened. In some processes, the total time can be reduced to less than two minutes, and even less than 90 seconds.

Most color negative films generally comprise little or no silver chloride in their emulsions, and have silver bromide as the predominant silver halide. More typically, the emulsions are silver iodobromide emulsions having up to several mole percent of silver iodide. Emulsions containing high silver chloride have generally had insufficient light sensitivity to be used in high speed materials although they have the advantage of being rapidly processed without major changes to the color developer solution.

However, considerable effort continues in the industry to develop and provide camera speed, light sensitive photographic films that contain predominantly silver chloride emulsions. See, e.g., U.S. Pat. No. 4,400,463 (Maskasky), U.S. Pat. No. 5,320,938 (House et al), and U.S. Pat. No. 5,451,490 (Budz et al).

To shorten the processing time, specifically the color development time, of films containing either silver iodobromide or silver chloride emulsions, more active color developer solutions have been proposed. Various attempts have been made to increase color developer activity by increasing the pH, increasing the color developing agent concentration, decreasing the halide ion concentration, or increasing temperature. However, when these changes are made, the stability of the solution or the photographic image quality is often diminished.

For example, when the color development temperature is increased from the conventional 37.8° C., and the color developer solution is held (or used) in the processing tanks for extended periods of times, elements processed with such solutions often exhibit unacceptably high density in the unexposed areas of the elements, that is unacceptably high Dmin. In particular, these shortened process time can lead to reduced effective photographic sensitivity or speed.

Stabilizing processing solutions for extended periods of time at high temperature in rapid color development of silver iodobromide films has been accomplished by the use of a specific hydroxylamine antioxidant, as described in copending and commonly assigned U.S. Ser. No. 08/590,241 (filed Jan. 23, 1996, by Cole).

Various methods have been proposed for overcoming problems encountered in processing high chloride silver halide elements. For example, novel antioxidants have been developed to stabilize developer solutions (e.g., U.S. Pat. No. 4,897,339 of Andoh et al, U.S. Pat. No. 4,906,554 of Ishikawa et al, and U.S. Pat. No. 5,094,937 of Morimoto). High silver chloride emulsions have been doped with iridium compounds, as described in EP-A-0 488 737. Dyes have been developed to eliminate dye remnants from rapid processing as described in U.S. Pat. No. 5,153,112 (Yoshida et al). Novel color developing agents have been proposed for rapid development as described in U.S. Pat. No. 5,278,034 (Ohki et al).

All of the foregoing means have been designed for processing low sensitivity, high silver chloride photographic papers, and are not generally effective for processing color negative silver chloride camera speed films.

U.S. Pat. No. 5,344,750 (Fujimoto et al) describes a method for processing elements containing silver iodobromide emulsions that is allegedly rapid, including color development for 40–90 seconds. The potential problems of low sensitivity and high fog in rapidly developed elements is asserted to be overcome by using a color development temperature and color developing agent and bromide ion concentrations in the color developer that are determined by certain mathematical relationships. This approach would not be useful for processing high silver chloride films because these films show unacceptably high fog and granularity under the proposed color development conditions.

Furthermore, the conditions described for color development of silver iodobromide films produce less than optimal sensitivity when used for developing silver iodochloride films.

Similarly, U.S. Pat. No. 5,455,146 (Nishikawa et al) describes a method for forming color images in photographic elements containing silver iodobromide emulsions that is allegedly rapid and includes color development for 30–90 seconds. The potential problems of gamma imbalance are asserted to be overcome by controlling the morphology or the light sensitive silver halide emulsion grains, the thickness and swell rate of the photographic film, and the ratio of 2-equivalent color couplers to total couplers in the red sensitive silver halide emulsion layer.

Likewise, EP-A 0 726 493 describes a method for forming color images in photographic elements having silver iodobromide emulsions that includes color development for 25 to 90 seconds.

However, the methods described in these references require a color negative film to be specifically constructed with the noted features to correct gamma imbalance, but they do not correct color imbalance produced by rapidly developing commercially available color negative films that do not have the noted features. In other words, the method of gamma correction requires a specific film and cannot be applied to just any film on the market. Moreover, there is no teaching in this reference about how silver chloride films can be processed in a rapid manner to have desired color balance.

After a color negative film has been photographically processed in the manner described above, it can be scanned to create a digital representation of the image. The most common approach to scanning an image is to record the transmission or a light beam, point-by-point or line-by-line. In color photography, blue, green and red scanning beams are modulated by the yellow, magenta and cyan image dyes, respectively. In a variant color scanning approach, the blue, green and red scanning beams are combined into a single white scanning beam modulated by the image dyes that is read through blue, green and red filters to create separate color records. These records can then be read into any convenient memory medium (for example, an optical disk). Systems in which the image is passed through an intermediate device, such as a scanner or computer, are often referred to as "hybrid" imaging systems.

A hybrid imaging system must include a method for scanning or otherwise measuring the individual picture elements of the photographic media, which serve as input to the system, to produce image-bearing signals. In addition, the system must provide a means for transforming the image-bearing signals into an image representation or encoding that is appropriate for the particular uses of the system.

Hybrid imaging systems have numerous advantages because they are free of many of the classical constraints of photographic embodiments. For example, systematic manipulation (for example, image reversal, and hue and tone alteration) of the image information, that would be cumbersome or impossible to accomplish in a controlled manner in a photographic element, is readily achieved. The stored information can be retrieved from memory to modulate light exposures necessary to recreate the image as a photographic negative, slide or print at will. Alternatively, the image can be viewed on a video display or printed by a variety of techniques beyond the bounds of classical photography, such as using electrophotography, ink jet printing, dye diffusion printing and other techniques known in the art.

U.S. Pat. No. 4,500,919 (Schreiber) describes an image reproduction system in which an electronic reader scans an original color image and converts it to electronic image-bearing signals. A computer workstation and an interactive operator interface including a video monitor, permit an operator to edit or alter the image bearing signals by means of displaying the image on the monitor. The workstation causes the output device to produce an inked output corresponding to the displayed image. The image representation or encoding is meant to represent the colorimetry of the image being scanned. Calibration procedures are described for transforming the image-bearing signals to an image representation or encoding so as to reproduce the colorimetry of a scanned image on the monitor and to subsequently reproduce the colorimetry of the monitor image on the inked output.

However, representation of the image recorded by the film is not necessarily the desired final image. U.S. Pat. No. 5,375,000 (Ray et al) teaches that the scanned image can be modified with a function representing the inverse of the film characteristic curve [density vs. log(exposure)] to obtain a representation of the image more closely representing the original image log(exposure). This approach could be used to restore the mismatched gammas in the negative film caused by rapid processing. However, modem color negative films are also designed to have chemical interactions (interimage) between the different color records to achieve a desired color position, and not necessarily a perfect rendition of the original scene. These interactions are dependent upon processing time and will produce color errors in a rapidly processed film. These changes in interimage cannot be corrected using conventional color correction tools but can be corrected when the image information has been transformed into a digital representation of the image density.

EP-A-0 624 028 (Giorgianni et al) describes an imaging system in which image-bearing signals are converted to a different form, image representation or encoding, representing the corresponding colorimetric values that would be required to match, in the viewing conditions of a uniquely defined reference viewing environment, the appearance of the rendered input image as that image would appear, if viewed in a specific input viewing environment. The described system allows for input from disparate types of imaging media, such as photographic negatives as well as transmission and reflection positives the image representation or encoding of that system is meant to represent the color appearance or the image being scanned (or the rendered color appearance computed from a negative being scanned), and calibration procedures are described so as to reproduce that appearance on the monitor and on the final output device or medium.

U.S. Pat. No. 5,267,030 (Giorgianni et al) describes a method for deriving, from a scanned image, recorded color information that is substantially free of color alterations produced by the color reproduction properties of the imaging element. In this reference, the described system computationally removes the effects of media-specific signal processing as far as possible, from each input element used by the system. In addition, the chromatic interdependencies introduced by the secondary absorptions of the image-forming dyes, as measured by the responsivities or the scanning device, are also computationally removed. Use of the methods described in this reference transforms the signals measured from the imaging element to the exposures recorded from the original image.

Copending and commonly assigned U.S. Ser. No. 08/729,937 (filed Oct. 15, 1996, by Bohan and Cole) describes a method for correcting color images in silver iodobromide films having conventional structures and layer orders and developed for 195 seconds. However, since silver chloride and silver iodobromide films are not necessarily interchangeable and processing conditions must be carefully tailored for each type of emulsion, the methods described therein are not necessarily useful for processing high silver chloride films.

Copending and commonly assigned U.S. Ser. No. 08/730,557 (filed Oct. 15, 1996, by Bohan, Buchanan and Szajewski) describes a method for color correcting images from high chloride tabular grain films and density limited films having conventional structures and layer orders. However, the methods described are not fully adequate to meet the need for very rapid image formation and presentation using a variety of image forming solutions.

There remains a need for a process for providing color display images from images originated in duplitized, camera speed color films, and for correcting color imbalances that occur in the color records resulting from the rapidity or variability of the film processing.

SUMMARY OF THE INVENTION

The problems noted above are overcome with a method for providing a color display image comprising the steps of:

A) color developing an imagewise exposed light sensitive silver halide color photographic element exhibiting a sensitivity of at least ISO 25, and comprising a support having thereon at least two color recording units, each of the at least two color recording units being sensitive to a distinct region of the electromagnetic spectrum, and each comprising at least one silver halide emulsion layer having light sensitive silver halide emulsion grains in reactive association with a compound capable of forming an image dye during a color development step, thereby providing at least two such silver halide emulsion layers sensitive to distinct regions of the electromagnetic spectrum in the element, wherein the support is interposed between two of the silver halide emulsion layers sensitive to distinct regions of the electromagnetic spectrum, with a color developer having a pH of from about 9 to about 12, and comprising a color developing agent at from about 0.01 to about 0.1 mol/l, and bromide ion at up to about 0.5 mol/l, at a temperature at or above about 35° C. for up to about 4 minutes, to provide a developed image, B) scanning the developed image to form density representative digital signals for the at least two color recording units, and C) digitally manipulating the density representative digital signals formed in step B to correct either or both interimage interactions and gamma mismatches among the at least two color recording units so as to produce a digital record of a corrected color image.

In a more particular embodiment of this invention, a method is used to provide a color display image by color developing the noted element described above, which has a flexible support that is substantially transparent after color photographic processing, and at least two of the noted color recording units, each color recording unit having at least one silver halide emulsion layer as noted above, thereby providing at least two silver halide emulsion layers. The flexible support is interposed between two of the noted silver halide emulsion layers that are sensitive to distinct regions of the electromagnetic spectrum. In addition, the element has a coated layer(s) thickness of up to about 30 μm on either side of the support, and contains up to about 0.2 mmol/m$^2$ of incorporated permanent Dmin adjusting dye and up to about 0.6 mmol/m$^2$ of color masking coupler. Color development is carried out with the color developer and under the conditions described above, to provide a developed image. This image is scanned and digitally manipulated as described herein to provide a digital record of a corrected color image.

Still further, this invention includes a method for providing a digitized image comprising the step of:

scanning an imagewise exposed and photographically processed light sensitive silver halide color photographic element as described above.

The method of this invention is carried out using what is identified herein as a "duplitized" color photographic element, meaning that it has at least one silver halide emulsion layer (and hence at least one color recording unit) on each side of the support, and at least two of those layers are sensitive to distinctly different regions of the electromagnetic spectrum (hence, at least two color recording units in the element).

The duplitized camera speed elements described herein are particularly suitable for rapid processing of the latent image into machine readable form, digitization by scanning of the image to create a digital image-representation, followed by digital manipulation, storage or digital driven formation of visually pleasing analog images. The method of providing a viewable image allows the reproduction of scenes photographed under low light conditions or in simple cameras while still providing high sensitivity, excellent depth of field and good color reproduction.

The method of this invention properly corrects for the color imbalance when duplitized color films are rapidly processed under certain color development conditions. Such errors in the color records are not correctable using conventional color printing techniques.

Since a controlling factor in image access time is the thickness of overlying layers relative to layers positioned closer to a support, disposition of light sensitive layers on opposing faces of a support obviates the problem and provides for extremely rapid access (or photographic processing) to a desired image. Quite surprisingly, the light sensitivity of the elements is improved in this arrangement.

DETAILED DESCRIPTION OF THE INVENTION

Figure 1:
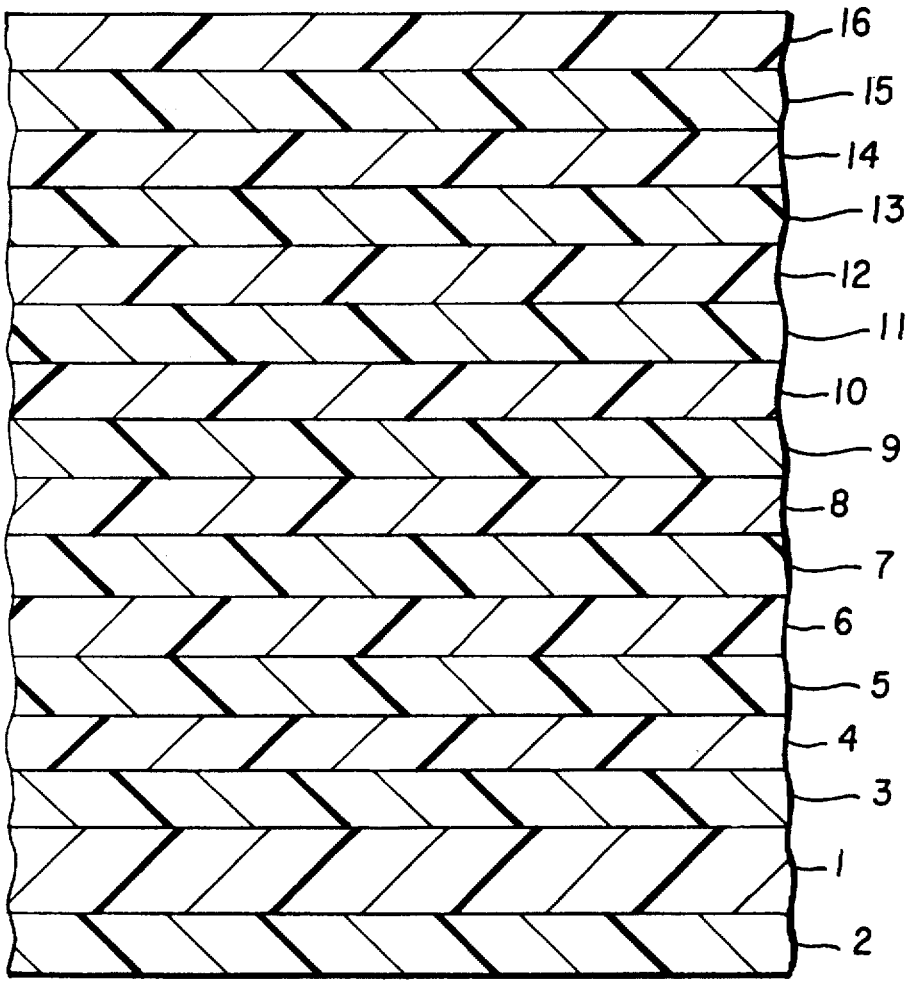
FIG. 1 is a cross-sectional view of a representative comparative color photographic element that is not useful in the practice of the present invention.

Generally the light sensitive elements useful in this invention will comprise a support having at least two, and preferably three or more, color records or color recording units. Each color recording unit can be comprised of a single emulsion layer or multiple emulsion layers sensitive to a given region of the spectrum. The support is characterized as having two sides or faces, and each support side or face has disposed thereon at least one light sensitive emulsion layer. The layers of the element can be otherwise arranged in any of the various orders known in the art.

In an alternative format, the emulsions sensitive to each of the three primary regions of the spectrum can be disposed as a single segmented layer. Such single segmented layers can be disposed on both sides of the support or the support may bear individual emulsion layers as well as a single segmented layer. The elements can also contain other conventional layers such as filter layers, interlayers, subbing layers, overcoats and other layers readily apparent to one skilled in the art.

In a preferred embodiment, a color recording unit will have at least two silver halide emulsion layers and in a more preferred embodiment, it will have at least three or more silver halide emulsion layers. It is especially preferred that more than one color recording unit comprise multiple light sensitive silver halide emulsion layers as described herein.

In a more preferred embodiment, the color photographic elements useful in the practice of this invention comprise a support bearing a red light sensitive color recording unit capable of forming a cyan dye deposit, a green light sensitive color recording unit capable of forming a magenta dye deposit and a blue light sensitive color recording unit capable of forming a yellow dye deposit. Alternatively, cross-colored recording units, or mixed colored recording units may be employed as is known in the art. Each color recording unit can produce a dye deposit having a hue distinguishable from the other color recording unit(s).

The dye deposits in each color recording unit or emulsion layer can be formed during a color development step which comprises contacting the color negative film with an alkaline solution containing a suitable color developing agent, such as a p-phenylenediamine color developing agent, that reduces exposed silver halide to metallic silver and is itself oxidized. The oxidized color developing agent in turn reacts with a photographic color coupler to form chromogenic cyan, magenta and yellow dye images, all as known in the art. The color coupler may be introduced into the film during processing but it is preferably present in the film before exposure and processing. The color coupler may be monomeric or polymeric in nature.

The color development step may be amplified by the presence of peroxides as is known in the art. The color developed element can then be optionally desilvered using any technique known in the art (usually including bleaching and fixing steps). After this photographic processing, the color image thus formed is borne on a support that is sufficiently transparent to enable the subsequent color scanning step of the invention.

The elements useful in this invention generally have a camera speed prior to image formation defined as an ISO speed of at least 25, preferably an ISO speed of at least 50, and most preferably an ISO speed of at least 100. The speed or sensitivity or color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27 1979 ASA speed) and relates to the exposure levels required to enable a density of 0.15 above fog in the green light sensitive and least sensitive color recording unit of a multicolor negative film. This definition conforms to the International Standards Organization (ISO) film speed rating.

Since the color densities produced in the color elements of this invention will be digitally amplified or deamplified as needed to produce the final output images, photographic speeds herein are reported based on the exposure required to produce a density of 0.15 above Dmin.

The layers of the photographic elements can have any useful binder material or vehicle known in the art, including various types of gelatins and other colloidal materials (or mixtures thereof). One useful binder material is acid processed gelatin that can be present in any layer in any suitable amount.

The total thickness of the coated layers on any one side of the support of the elements used in this invention can be from about 3 μm to about 30 μm in thickness (preferably up to about 24 μm, more preferably up to about 18 μm, and most preferably up to about 14 μm in thickness), so as to improve image sharpness and to promote access of processing chemicals to the coated emulsion layers. Further, the coated layers should swell during processing. The extent of swell can be quantified as the ratio of wet thickness to dry thickness of the coated layers. Swell ratios of between about 1.2 and about 6 are contemplated for these elements, while swell ratios of between about 1.5 and 3.0 are preferred. Smaller degrees of swell generally correspond to higher tortuosity and greater difficulty for processing solutions to enter and leave the coated layers. Larger degrees of swell can result in poor physical integrity of the coated layers. Thickness and swell can be measured by microscopic examination of cross-sections of the elements, or by direct measurement of film sample thickness, using conventional procedures.

In a preferred embodiment, the supports of the duplitized elements useful in this invention are thin, flexible and substantially transparent both before and after photographic processing and before digital scanning. Suitable materials for such supports are well known and generally include well known transparent polymeric materials such as polyesters, polycarbonates, polystyrenes, cellulose acetates, cellulose nitrate, and other materials two numerous to mention. Preferred support materials include, but are not limited to polyesters such as poly(ethylene terephthalate) and poly (ethylene naphthalate).

By "substantially transparent" is meant that the support will have an optical color density of less than about 0.1 to red, green or blue light in the 450 to 700 nm range. More preferably, the supports have an optical density after processing of less than about 0.05 on average, to red, green and blue light. This limited density improves both the initial exposure of the elements to light and the subsequent scanning and digitization of the imagewise exposed and processed film. Such supports are generally transparent at all times, but in some cases, supports can be used that are partially opaque or reflective before processing and substantially transparent after color processing. Additionally, supports having a magnetic recording layer as knows in the art and as described in *Research Disclosure* Item #34390 published November 1992 are particularly useful in the practice of this invention.

The supports useful in the practice of this invention will generally be sufficiently thin and flexible to enable ready spooling. Such supports will generally be from about 40 μm to about 150 μm thick, preferably up to about 130 μm thick, more preferably up to about 110 μm thick, and even more preferably of up to about 90 μm thick. The flexibility of such supports will be adequate so long as they can be bent without suffering fractures or physical blemishes. The degree of bend can be quantified as a radius of curvature (ROC). A ROC of less than about 6,500 μm without fractures or physical blemishes is generally adequate. It is preferred that the supports be bendable through a ROC of less than about 6,000 μm, more preferred that they be bendable through a ROC of less than about 5,500 μm and most preferred that they be bendable through a ROC of less than about 5,000 μm.

The support transparency, thickness and flexibility requirements for a duplitized chromogenic color film intended to be used in roll form in a hand held camera are quite different from the thickness and flexibility requirements for supports employed in duplitized monochromatic radiographic incorporated silver image films, that is X-ray films, where substantially thicker (typically 180 or more μm), non-flexible and tinted supports are employed.

The elements can additionally comprise bleachable or removable antiscatter and/or antihalation dyes. These dyes can be bleached by heat or by contact with a processing solution, or they can be removed during contact with a processing solution. The dyes can be located relative to the light-sensitive color recording units or layers as is known in the art. For example, when employed as antihalation dyes, the dyes will absorb in the region of the spectral sensitivity of overlying layers.

Considerable details of element structure and components, and suitable methods of processing various types of elements are described in *Research Disclosure A*, noted below. Included within such teachings in the art is the use of various classes of cyan, yellow and magenta color couplers that can be used with the present invention. In particular, the present invention can be used to color develop photographic elements containing pyrazolotriazole magenta dye forming couplers.

It is generally preferred that the dyes formed during the development step be well separated in hue and be spectrally broad in shape. The scanning and digitization steps are further enhanced by designing the color records to have an overall maximum density of less than about 2 so as to minimize scanner noise. Further, it is preferred that Density vs. log E curves of the imagewise exposed films be monotonic after processing so as to enable the use of exposure independent digital deconvolution of the scanned image. Digital deconvolution is further improved by providing color elements having exposure independent chemical and optical interimage effects. In a preferred embodiment, the color camera speed element useful in this invention is a color negative film having an exposure latitude of at least about 1.5 log E and preferably having an exposure latitude of at least about 2 log E, more preferably having an exposure latitude of at least about 2.5 log E, and most preferably having an exposure latitude of at least about 3.0 log E. Exposure latitudes of up to about 6 to 10 log E are contemplated. As is well understood in the art, exposure latitude defines the useful range of exposure conditions which may be recorded on a light sensitive element. These preferred exposure latitudes enable improved scene recording under a wide variety of lighting conditions. Further, the dye color records will have gammas (i.e., slopes of D v log E curves) of between about 0.1 and 1.0. The gammas will preferably be less than about 0.7, more preferably be less than about 0.5 and most preferably be between about 0.2 and 0.45. The utility of such gamma control is described in U.S. Pat. No. 5,500,315 (Bogdanowicz et al) and U.S. Ser. No. 08/560,134 (Keech et al, filed Nov. 17, 1995, as a continuation of U.S. Ser. No. 08/246,598, filed May 20, 1994, now abandoned), the disclosures of which are incorporated by reference.

In a preferred embodiment of this invention, the photographic elements useful herein contain only limited amounts of color masking couplers and incorporated permanent Dmin adjusting dyes. Generally, such elements contain color masking couplers in total amounts up to about 0.6 mmol/m$^2$, preferably in amounts up to about 0.2 mmol/m$^2$, more preferably in amounts up to about 0.05 mmol/m$^2$, and most preferably in amounts up to about 0.01 mmol/m$^2$.

The incorporated permanent Dmin adjusting dyes are generally present in total amounts up to about 0.2 mmol/m$^2$, preferably in amounts up to about 0.1 mmol/m$^2$, more preferably in amounts up to about 0.02 mmol/m$^2$, and most preferably in amounts up to about 0.005 mmol/m$^2$.

Limiting the amount of color masking couplers and incorporated permanent Dmin adjusting dyes serves to reduce the optical density or the elements, after processing, in the 450 to 650 nm range, and thus improves the subsequent scanning and digitization of the imagewise exposed and processed duplitized elements.

Overall, the limited Dmin and tone scale density enabled by controlling the quantity of incorporated color masking couplers, incorporated permanent Dmin adjusting dyes and support optical density can serve to both limit scanning noise (which increases at high optical densities), and to improve the overall signal-to-noise characteristics of the element to be scanned. Relying on the digital correction step to provide color correction obviates the need for color masking couplers in the elements. When the density sources are thusly controlled, the silver halide emulsions need not be predominantly silver chloride emulsion, but can then be predominantly silver bromide emulsions, as described above. However, if processing time is to be shortened, the best emulsions are predominantly silver chloride emulsions as described above, with or without color masking couplers.

In a preferred embodiment, the elements useful in this invention have three color recording units, including a red light-sensitive color recording unit having a peak spectral sensitivity between about 600 and 700 nm, a green light-sensitive color recording unit having a peak spectral sensitivity between about 500 and 600 nm, and a blue light-sensitive color recording unit having a peak spectral sensitivity between about 400 and 500 nm. While any combination of spectral sensitivities can be used in the elements, the spectral sensitivities of copending and commonly assigned U.S. Ser. Nos. 08/469,062 and 08/466,862, both filed Jun. 6, 1995, by Giorgianni et al, are particularly useful in this invention.

Additional auxiliary color recording units with distinct spectral sensitivities as known in the art can also be present in the element. While the red, green and blue color recording units generally produce cyan, magenta and yellow dye images, respectively, other combinations of useful record sensitivity produced dye images are known and are specifically contemplated for use in the practice of this invention. In particular, the hues of the chromogenic dyes may be chosen to better match the spectral sensitivities of image scanning devices.

In a preferred embodiment, at least one of a green and or red light sensitive emulsion layers will be provided closer to an exposure source than a blue light sensitive emulsion layer. This particular layer order is especially preferred since the human eye is less sensitive to blue light spatial information than to green light or red light spatial information.

By disposing a blue light sensitive layer further from an exposure source, the spatial information carried by green or red light is initially recorded with greater fidelity since it need not pass through a scattering blue light sensitive emulsion layer before exposing a green or red light sensitive emulsion layer. In an especially preferred embodiment, at least one of a green or red light sensitive emulsion layer is arranged one side of the support and a blue light sensitive emulsion layer is arranged on the opposite side of the support, and the element is exposed such that light exposes the red or green emulsion layer before striking the support and in turn exposing the blue light sensitive emulsion layer.

While such layer orders are avoided in camera speed films intended for optical printing after optional enlargement, due to the inability of the art to provide adequate chemical based color corrections whether by masking compounds, or Development Inhibitor Releasing (DIR) compounds, such constraints are obviated by the digital scanning and color correction steps employed in specific embodiments of this invention. It is additionally contemplated that either general or color specific digital image sharpening be applied to images recorded in this fashion so as to better supply both sharp and colorful images.

When the elements useful in this invention are supplied in spooled form, care must be taken that the elements or films are spooled such that specific layers as described above are positioned appropriately to an exposure source, for example a camera lens, when the spooled film is loaded in a camera.

FIG. 1, not to scale, is a cross-sectional view of a film structure or layer order of a typical comparative color element (or control). That is, it is a film outside the scope of this invention. Support 1 bears on one side, protective layer 2, which may in practice comprise one or more than one physical layers so long as the protective functionality is provided. For example it may comprise a subbing layer, a layer with antistatic properties, a layer with antihalation properties and a magnetic recording layer. A subbing layer is a layer designed to promote adhesion of the binder for the light sensitive layers and auxiliary layer to the support. Layer 3 is a layer having subbing, spark protective, light protective, and antihalation properties. These properties are typically supplied by combinations of dyes and gray silver. Layer 4 is an isolation layer to isolate a light sensitive layer from a layer having antihalation properties.

Layer 5 is a less red light sensitive silver halide emulsion layer, layer 6 is a moderately red light sensitive silver halide emulsion layer and layer 7 is a most red light sensitive silver halide emulsion layer. Layers 5, 6, and 7 typically additionally comprise cyan dye-forming couplers, development inhibitor releasing couplers, bleach accelerator releasing couplers and cyan dye-forming magenta and yellow masking couplers.

Layer 8 is an isolation layer comprising gelatin and interlayer scavengers. Layer 9 is a less green light sensitive silver halide emulsion layer, layer 10 is a moderately green light sensitive silver halide emulsion layer and layer 11 is a most green light sensitive silver halide emulsion layer. Layers 9, 10 and 11 typically additionally comprise magenta dye-forming couplers, development inhibitor releasing couplers, bleach accelerator releasing couplers and magenta dye-forming yellow masking couplers.

Layer 12 is an isolation layer comprising gelatin, optionally yellow filter materials which may include yellow filter dyes and Carey Lea silver and interlayer scavengers. Layer 13 is a less blue light sensitive silver halide emulsion layer, and layer 14 is a most blue light sensitive silver halide emulsion layer. Layers 13 and 14 typically additionally comprise yellow dye-forming couplers, development inhibitor releasing couplers, bleach accelerator releasing couplers and such.

Layer 15 is a protective overcoat layer having UV protective dyes and fine particulate silver halides which can function to scavenge harmful development byproducts from development solutions. Layer 16 is a second protective overcoat which may contain lubricants and anti-matte beads.

A comparative element having the structure shown in FIG. 1 can be spooled such that light from an exposure source strikes layer 16 first and only strikes the support after passing through all of the light sensitive emulsion layers.

Figure 2:
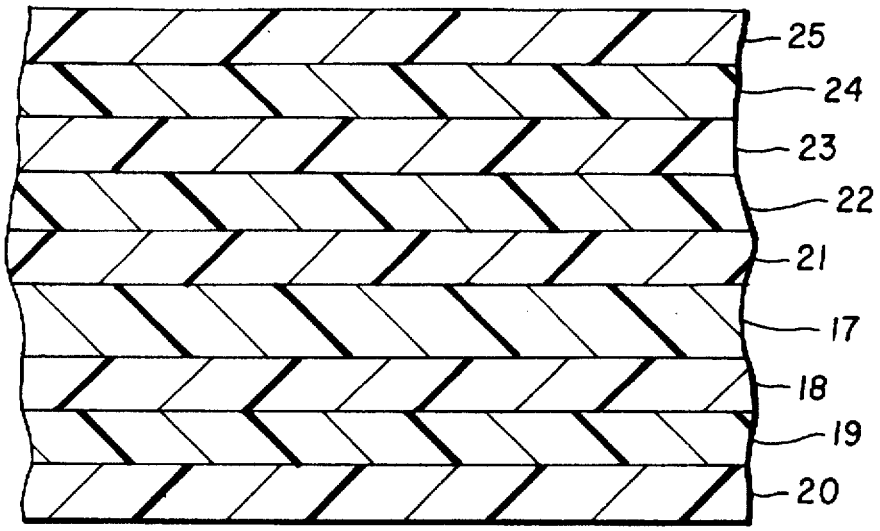
FIG. 2 is a cross-sectional view of a representative duplitized color photographic element that is useful in the practice of the present invention having at least one color image forming layer on each side of the support.

FIG. 2, not to scale, is a cross-sectional view illustrating an element useful in the present invention. Support 17 has the characteristics already described. Layer 18 is a subbing layer. Layer 19 is a blue light sensitive silver halide emulsion layer comprising a yellow dye-forming compound. Layer 20 is a protective overcoat comprising antihalation and spark protective (that is ultraviolet light protective) components as well as anti-matte agents and lubricants. Protective layer 20 may in practice comprise one or more than one physical layers so long as the protective functionality is provided.

Layer 21 is a subbing layer which may optionally comprise removable dyes which absorb red and or green light. Layer 22 is a red light sensitive silver halide emulsion layer comprising a cyan dye-forming compound. Layer 23 is an isolation layer which optionally comprises interlayer scavengers and green light absorbing dyes. Layer 24 is a green light sensitive silver halide emulsion layer comprising magenta dye-forming compounds. Layer 25 is a protective overcoat comprising spark protective (that is ultra-violet light protective) components as well as anti-matte agents and lubricants. Protective layer 25 may in practice comprise one or more physical layers so long as the protective functionality is provided.

Figure 3:
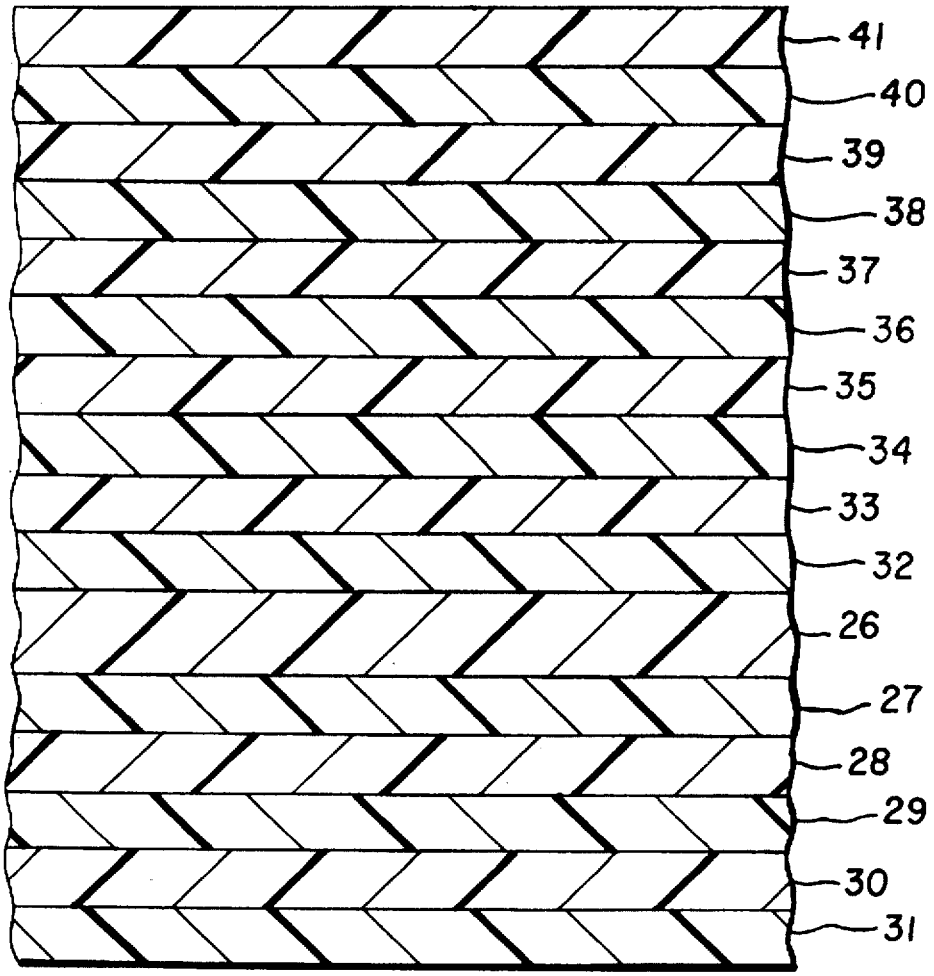
FIG. 3 is a cross-sectional view of another embodiment of a duplitized color photographic element that is useful in the practice of the present invention.

FIG. 3, not to scale, is a cross-sectional view illustrating another structure or layer order of a color element useful in the practice of this invention. Support 26 bears on one side, subbing layer 27 which may in practice comprise one or more physical layers so long as the subbing functionality is provided. For example, it may comprise a subbing layer, a layer with antistatic properties, a layer with antihalation properties and a magnetic recording layer. Layer 28 is a most blue light sensitive silver halide emulsion layer, and layer 29 is a less blue light sensitive silver halide emulsion layer. Layers 28 and 29 typically additionally comprise yellow dye-forming couplers, development inhibitor releasing couplers, bleach accelerator releasing couplers and such. They may also comprise yellow dye forming cyan and or magenta masking compounds.

Layer 30 is a protective overcoat layer having UV protective dyes and optionally comprising fine particulate silver halides which can function to scavenge harmful development byproducts from development solutions. Layer 31 is a protective overcoat which may contain lubricants and anti-matte beads. At least one of layers 30 and 31 may include antihalation dyes or gray silver and antistatic agents. These are typically supplied by combinations of dyes and/or gray silver as the particular properties of the element and system warrant.

Layer 32 represents a subbing layer and may in practice comprise one or more physical layers so long as the subbing functionality is provided. For example, it may comprise a subbing layer, a layer with antistatic properties, a layer with antihalation properties and a magnetic recording layer.

Layer 33 is a less red light sensitive silver halide emulsion layer, layer 34 is a moderately red light sensitive silver halide emulsion layer and layer 35 is a most red light sensitive silver halide emulsion layer. Layers 33, 34, and 35 typically additionally comprise cyan dye-forming couplers, development inhibitor releasing couplers, bleach accelerator releasing couplers and may optionally comprise cyan dye-forming magenta masking couplers. Layer 36 is an isolation layer comprising gelatin and interlayer scavengers.

Layer 37 is a less green light sensitive silver halide emulsion layer, layer 38 is a moderately green light sensitive silver halide emulsion layer and layer 39 is a most green light sensitive silver halide emulsion layer. Layers 37, 38 and 39 typically additionally comprise magenta dye-forming couplers, development inhibitor releasing couplers, and bleach accelerator releasing couplers.

Layer 40 is a protective overcoat layer having UV protective dyes and fine particulate silver halides which can function to scavenge harmful development byproducts from development solutions. Layer 41 is a protective overcoat which may contain lubricants and anti-matte beads. An element having the structure shown in FIG. 3 is spooled such that light from an exposure source strikes layer 41 first and strikes the support after passing through some but not all of the light sensitive emulsion layers.

Other layer orders and arrangements relative to the support are additionally useful in the practice of this invention. In the following listing of layer orders, these abbreviations are employed:

FY is a most light sensitive blue light sensitive layer,

SY is a less light sensitive blue light sensitive layer,

FM is a most light sensitive green light sensitive layer,

MM is a moderately sensitive green light sensitive layer,

SM is a less light sensitive green sensitive layer,

FC is a most light sensitive red light sensitive layer,

MC is a moderately sensitive red light sensitive layer,

SC is a less light sensitive red sensitive layer,

BG is a blue & green light sensitive layer,

GR is a green & red light sensitive layer,

BR is a blue & red light sensitive layer,

XXX is the support, and

→indicates the exposure source.

Representative useful layer orders include, but are not in any way limited to the following:

→FM/FC/XXX/FY,

→FC/FM/XXX/FY,

→FM/XXX/FC/FY,

→FM/FC/FY/XXX/SY,

→FM/FC/SM/SC/XXX/FY/SY,

→MM/SM/MC/SC/MY/SY/XXX/FM/FC/FY,

→MM/SM/MC/SC/XXX/FM/FC/FY/SY,

→FY/FM/FC/XXX/SY/SM/SC,

→FM/FC/MM/MC/XXX/SM/SC/FY/SY,

→FM/FC/XXX/GR/FY,

→FM/FC/XXX/FY/BG, and

→FM/FC/XXX/FY/BR.

In these illustrated embodiments, the various auxiliary layers described above for other embodiments have been omitted for clarity.

Figure 4:
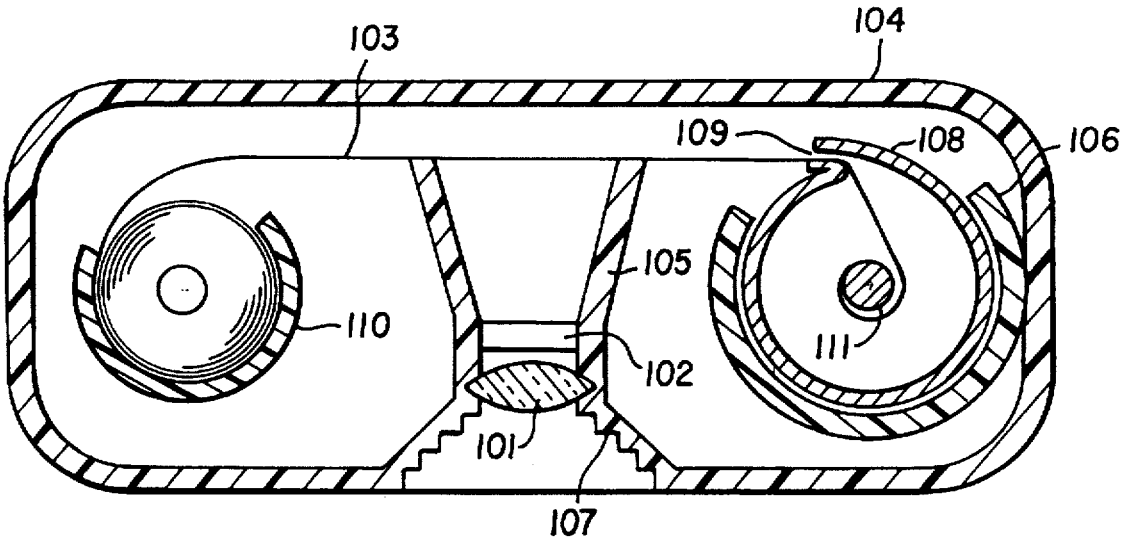
FIG. 4 is a cross-sectional view of a camera containing a duplitized photographic element useful in this invention, in spooled form as aligned with a camera lens.

FIG. 4 shows a cross-sectional view of a camera with an element in spooled form as aligned with a camera lens. Lens 101 and shutter 102 (schematically shown) are mounted in housing 104 internally forming an exposure plane locator 105 and externally, surrounding the lens forming a lens protective concavity 107. Cartridge holder 106 is located within housing 104 and contains spool cartridge 108 provided with spindle 111 and aperture 109 for transport of film 103. Spool cartridge 108 is generally light tight and carries along the aperture a felt or other flexible membrane (not shown) that allows film transport into and out of spool cartridge 108 without scratching. Separated from cartridge holder 106 is roll film holder 110. Film 103 is mounted in housing 104 and rolled upon itself in spool cartridge 108. In use, spool cartridge 108 is mounted in housing 104 and a portion of film 103 extends through cartridge aperture 109 and across exposure plane locator 105. Opening the shutter allows light to enter through lens 101 and to expose film 103 from a particular direction.

Although not illustrated in FIG. 4, film 103 could be like those films illustrated in FIG. 2 or 3. Thus, when mounted in the camera in FIG. 4, film 103 is mounted so that when light enters lens 101, it strikes the red and/or green light sensitive emulsion layer(s) and passes through the film support before the light strikes the blue light sensitive emulsion layer(s) on the opposite side of the support.

Although a particular type of camera is illustrated here, the general alignment of spool cartridge, lens and element is standard in the photographic industry and provides compatibility between roll films and cameras supplied by different manufacturers. Specifically, in the context of this popular standard, the direction of exposure of the element is dictated by the face of the element that is wound inwardly towards the spindle of the spool cartridge. While the element useful in the practice of this invention is intended for use in fully compatible spool cartridges and cameras, its use in non-compatible, that is inverted or mirror image element, spool and lens arrangements is also specifically contemplated. The characteristics of a support which enable such spooling have already been described.

In another embodiment (not shown), a spool cartridge having a mechanical gate to ensure light tightness may be employed.

Further details of other element requirements and camera characteristics that are especially useful in combination with the elements and methods of this invention are described in U.S. Pat. No. 5,422,231 (Nozawa) and U.S. Pat. No. 5,466,560 (Sowinski et al) the disclosures of which are incorporated by reference for all that they teach.

Use of the elements described herein in Single-Use-Cameras, miniaturized cameras, Eastman Kodak's ADVANCED PHOTOSYSTEM® cameras and cartridges and Fuji Photo Company's SMART® cameras and cartridges is specifically contemplated.

Single-Use-Cameras are known in the art under various names: films with a lens, photosensitive material package units, box cameras and photographic film packages. Other names are also used, but regardless of the name, each shares a number of common characteristics. Each is essentially a photographic product (camera) provided with an exposure function and preloaded with a photographic element (or film). The photographic product comprises an inner camera shell loaded with the photographic element, a lens opening and lens, and an outer wrapping(s) of some sort. The photographic elements are exposed in camera, and then the product is sent to the developer who removes the element and photographically processes it. Return of the product to the consumer does not normally occur. Single-Use-Cameras and their methods of manufacture and use are described, for example, in U.S. Pat. No. 4,801,957, U.S. Pat. No. 4,901, 097, U.S. Pat. No. 4,866,459, U.S. Pat. No. 4,849,325, U.S. Pat. No. 4,751,536 and U.S. Pat. No. 4,827,298, and EP-A-0 460 400, EP-A-0 533 785 and EP-A-0 537 225, all of which are incorporated herein by reference.

Other cameras are designed to accommodate film cartridges containing duplitized elements as described herein, which cartridges can retain the elements for storage even after photographic processing. Examples of such cameras are described for example in U.S. Pat. No. 5,550,608 (Smart et al), and include those cameras marketed by Eastman Kodak Co. under the trademark ADVANTIX® cameras. Film cartridges useful in those cameras are marketed under the same trademark.

Both negative working and positive working emulsions may be employed in the practice of this invention. These emulsions can be of any regular crystal morphology (such as cubic, octahedral, cubooctahedral or tabular as are known in the art) or mixtures thereof, or irregular morphology such as multiple twinning or rounded). In a preferred embodiment, the element comprises tabular shaped grains. The size of tabular grains, expressed as an equivalent circular diameter, is determined by the required speed for the applied use, but is preferably from about 0.06 to about 10 μm, and more preferably, from about 0.1 to about 5 μm.

In a preferred embodiment, the present invention is particularly useful for processing camera speed negative working photographic elements containing at least one silver chloride emulsion having at least 50 mol % silver chloride. Preferably, at least one silver halide emulsion contains at least 70 mol % silver chloride, and more preferably, at least 90 mol % silver chloride. Generally, the iodide ion content of such silver chloride emulsions is less than about 6 mol % (based on total silver), preferably from about 0.05 to about 2 mol %, and more preferably, from about 0.1 to about 1 mol %. Substantially the remainder of the silver halide is silver chloride.

Camera speed negative working photographic elements containing at least one high silver bromide emulsion may also be employed in the present invention. Here, at least one silver halide emulsion has at least 50 mol % silver bromide and preferably, at least 70 mol % silver bromide, and more preferably, at least 90 mol % silver bromide may be employed. Generally, the iodide ion content of such preferred silver bromide emulsions is less than about 15 mol % (based on total silver), preferably from about 0.1 to about 6 mol %, and more preferably, from about 1 to about 5 mol %.

The photographic elements useful in the practice of this invention may also comprise both high silver chloride and high silver bromide emulsions. When the element comprises both types of emulsions, they may be segregated by color recording unit, such as by concentrating the high silver bromide emulsions in the blue light sensitive emulsion layers. Alternatively, elements comprising both types of emulsions may have emulsions segregated by position, such as by concentrating the high silver bromide emulsions in layers further from an exposure source or by concentrating such high silver bromide emulsions in layers closer to a chemical processing solution interface and further from a support interface.

In a particular embodiment of this invention, when the quantities of incorporated color masking couplers and incorporated Dmin adjusting dyes are purposely limited (as described in detail below), the elements processed according to this invention can even more profitably employ high silver bromide emulsions. For example, while the high silver chloride emulsions, and especially those having limited silver iodide content continue to enable excellent results, similar excellent results can additionally be obtained using emulsions having a lower silver chloride content. Specifically, the emulsions can be predominantly silver bromide as already described with the remainder being silver chloride and silver iodide. Useful image to fog discrimination can be achieved with such elements at limited color development times because the extraneous density provided by the masking couplers and Dmin adjusting dyes is purposely minimized.

The silver halide emulsions particularly useful in the practice of this invention can comprise tabular silver halide grains that are bounded by either {100} major faces having adjacent edge ratios of less than 10 or by {111} major faces. In both cases, grains having an average aspect ratio of at least 2 and generally less than about 100 are preferred. When high chloride tabular grains are used in the practice of this invention, the {100} grains are preferred because of their more facile precipitation and sensitization and because of their often superior speed-grain performance. Generally, at least 50 mol % of the total silver halide is silver chloride in such emulsions. Further details of such {100} emulsions are provided by U.S. Pat. No. 5,314,798 (Brust et al), U.S. Pat. No. 5,320,938 (House et al), U.S. Pat. No. 5,395,746 (Brust et al), U.S. Pat. No. 5,413,904 (Chang et al), and U.S. Pat. No. 5,443,943 (Szajewski et al), all incorporated herein by reference for all they disclose.

The {111} high chloride tabular emulsions useful in the practice of this invention comprise a chemically and spectrally sensitized tabular silver halide emulsion population comprised of at least 50 mole percent chloride, based on silver, wherein at least 50 percent of the grain population projected area is accounted for by tabular grains bounded by {111} major faces, each having an aspect ratio of at least 2 and each being comprised of a core and a surrounding band containing a higher level of bromide or iodide ion than is present in the core, the band containing up to about 30 percent of the silver in the tabular grain. High chloride {111} tabular emulsions especially useful in the practice of this invention are described in copending and commonly assigned U.S. Ser. Nos. 08/583,577 (filed Jan. 5, 1996, by Szajewski) and Ser. No. 08/625,622 (filed Mar. 29, 1996, by Szajewski), the disclosures of which are incorporated by reference for all they disclose.

When high silver bromide emulsions are employed, again, both {111} and {100} high silver bromide emulsions may be usefully employed. Such emulsions are well known in the art and are described in detail in the several *Research Disclosure* citations listed below.

In one embodiment, the red or green light sensitive layer comprises a silver halide emulsion having at least 50 mol % silver chloride, and the blue light sensitive layer comprises an emulsion having at least 50 mol % silver bromide. In such embodiments, the red or green light sensitive layer (or both) is disposed on one side of the support while the blue light sensitive layer is disposed on the other side.

Both the high silver chloride and the high silver bromide emulsions useful in this invention are preferably spectrally sensitized as known in the art and chemically sensitized, doped or treated with various metals and sensitizers, again as known in the art. These chemical sensitizers include iron, sulfur, selenium, iridium, gold, platinum or palladium so as to modify or improve the emulsion properties. The emulsions can also be reduction sensitized during the preparation of the grains by using thiourea dioxide and thiosulfonic acid according to the procedures in U.S. Pat. No. 5,061,614 (Takada et al). The grains may be spectrally sensitized as known in the art.

Further details of such elements, their emulsions and other components are well known in the art. A useful compendium of such information can be found in *Research Disclosure*, publication 38957, pages 532–639 (September 1996) referred to herein as "*Research Disclosure A*", for descriptions and details of color forming elements see *Research Disclosure*, publication 37038 (February 1995) referred to herein as "*Research Disclosure B*", for descriptions of silver halide elements and emulsions see *Research Disclosure*, publication 308119 (December 1989) referred to herein as "*Research Disclosure C*", for descriptions of silver halide elements and emulsions particularly useful in elements intended for use in hand held cameras see *Research Disclosure*, publication 36230 (June 1994) referred to herein as "*Research Disclosure D*". *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011).

The elements described herein are color developed using a color developer solution having a pH of from about 9 to about 12 (preferably from about 9.5 to about 11.0). The color developer solution pH can be adjusted with acid or base to the desired level, and the pH can be maintained using any suitable buffer having the appropriate acid dissociation constants, such as carbonates, phosphates, borates, tetraborates, glycine salts, leucine salts, valine salts, proline salts, alanine salts, aminobutyric acid salts, lysine salts, guanine salts and hydroxybenzoates or any other buffer known in the art to be useful for this purpose.

The color developer also includes one or more suitable color developing agents, in an amount of from about 0.01 to about 0.1 mol/l, and preferably at from about 0.02 to about 0.06 mol/l. Any suitable color developing agent can be used, many of which are known in the art, including those described in *Research Disclosure A*, noted above. Particularly useful color developing agents include but are not limited to, aminophenols, p-phenylenediamines (especially N,N-dialkyl-p-phenylenediamines) and others that are well known in the art, such as EP-A 0 434 097 (published Jun. 26, 1991) and EP-A 0 530 921 (published Mar. 10, 1993). It may be useful for the color developing agents to have one or more water-solubilizing groups.

Bromide ion can be included in the color developer, preferably in an amount of up to about 0.5 mol/l, preferably up to about 0.3 mol/l, more preferably up to about 0.1 mol/l and most preferably in an amount of up to about 0.05 mol/l. It is preferred that at least about 0.00005 mol/l bromide ion, more preferred that at least about 0.0001 mol/l bromide ion and even more preferred that at least 0.002 mol/l of bromide ion be present in the developer solution. It is most preferred that at least about 0.003 mol/l of bromide be present in especially rapid color developer solutions intended for us with elements having high silver bromide (over 50 mol %) content based on incorporated silver. When the light sensitive silver halide in the element is predominately silver chloride, then it is especially preferred that the developer solution comprise at least 0.003 mold of chloride ion. Bromide and chloride ions can be provided in any suitable salt such as sodium bromide, lithium bromide, potassium bromide, ammonium bromide, magnesium bromide, calcium bromide, or the corresponding chlorides.

In addition to the color developing agent, bromide salts and buffers, the color developer can contain any of the other components commonly found in such solutions, including but not limited to, preservatives (also known as antioxidants), metal chelating agents (also known as metal sequestering agents), antifoggants, development inhibitors, optical brighteners, wetting agents, stain reducing agents, surfactants, defoaming agents, auxiliary developers (such as those commonly used in black-and-white development), development accelerators (such as triazolium thiolates), and water-soluble polymers (such as a sulfonated polystyrene or a polyvinyl pyrrolidone). These additional components are well known in the art as described in the *Research Disclosure* citations and in U.S. Pat. No. 4,937,178 and U.S. Pat. No. 5,118,591 (both Koboshi et al), the disclosures of which are incorporated by reference.

Useful preservatives include, but are not limited to, hydroxylamines, hydroxylamine derivatives, hydroxamic acid, hydrazines, hydrazides, phenols, hydroxyketones, aminoketones, saccharides, sulfites, bisulfites, salicylic acids, alkanolamines, β-amino acids, polyethyleneimines, and polyhydroxy compounds. Mixtures of preservatives can be used if desired. Hydroxylamine or hydroxylamine derivatives are preferred.

Antioxidants particularly useful in the practice are represented by the formula:

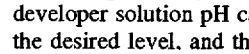

R-L-N(OH)-L'-R' wherein L and L' are independently substituted or unsubstituted alkylene of 1 to 8 carbon atoms (such as methylene, ethylene, n-propylene, isopropylene, n-butylene, 1,1-dimethylethylene, n-hexylene, n-octylene, and sec-butylene), or substituted or unsubstituted alkylenephenylene of 1 to 3 carbon atoms in the alkylene portion (such as benzylene, dimethylenephenylene, and isopropylenephenylene).

The alkylene and alkylenephenylene groups can also be substituted with up to 4 substituents that do not interfere with the stabilizing effect of the molecule, or the solubility of the compound in the color developer solution. Such substituents must be compatible with the color developer components and must not negatively impact the photographic processing system, and include, but are not limited to, alkyl of 1 to 6 carbon atoms, fluoroalkyl groups of 1 to 6 carbon atoms, alkoxy of 1 to 6 carbon atoms, phenyl, hydroxy, halo, phenoxy, alkylthio of 1 to 6 carbon atoms, acyl groups, cyano, or amino.

In the noted formula, R and R' are independently hydrogen, carboxy, sulfo, phosphono, carbonamido, sulfonamido, hydroxy, alkoxy (1 to 4 carbon atoms) or other acid groups, provided that at least one of R and R' is not hydrogen. Salts of the acid groups are considered equivalents in this invention. Thus, the free acid forms of the hydroxylamines can be used, as well as the organic or inorganic salts of the acids, such as the alkali metal, pyridinium, tetramethylammonium, tetraethylammonium and ammonium salts. The sodium and potassium salts are the preferred salts. In addition, readily hydrolyzable ester equivalents can also be used, such as the methyl and ethyl esters of the acids. When L or L' is alkylenephenylene, the carboxy, sulfo or phosphono group is preferably at the para position of the phenylene, but can be at other positions if desired. More than one carboxy, sulfo or phosphono group can be attached to the phenylene radical.

Preferably, one or both of R and R' are hydrogen, carboxy or sulfo, with hydrogen and sulfo (or salts or readily hydrolyzable esters thereof) being more preferred. Most preferably, R is hydrogen and R' is sulfo (or a salt thereof).

Preferably, L and L' are independently substituted or unsubstituted alkylene of 3 to 6 carbon atoms (such as n-propyl, isopropyl, n-butyl, sec-butyl, t-butyl, n-pentyl, 1-methylpentyl and 2-ethylbutyl), or substituted or unsubstituted alkylenephenylene having 1 or 2 carbon atoms in the alkylene portion (such as benzyl, and dimethylenephenyl).

More preferably, at least one, and optionally both, of L and L' is a substituted or unsubstituted alkylene group of 3 to 6 carbon atoms that is branched at the carbon atom directly attached (that is, covalently bonded) to the nitrogen atom of the hydroxylamine molecule. Such branched divalent groups include, but are not limited to, isopropylene, sec-butylene, t-butylene, sec-pentylene, t-pentylene, sec-hexylene and t-hexylene. Isopropylene is most preferred.

In one embodiment, L and L' are the same. In other and preferred embodiments, they are different. In the latter embodiment, L is more preferably a branched alkylene as described above, and L' is a linear alkylene of 1 to 6 carbon atoms (such as methylene, ethylene, n-propylene, n-butylene, n-pentylene and n-hexylene).

Representative hydroxylamine derivatives useful of the noted formula include, but are not limited to, N-isopropyl-N-(2-ethanesulfonic acid)hydroxylamine, N,N-bis(propionic acid)hydroxylamine, N,N-bis(2-ethanesulfonic acid)hydroxylamine, N-isopropyl-N-(n-propylsulfonic acid)hydroxylamine, N-2-ethanephosphonic acid-N-(propionic acid)hydroxylamine, N,N-bis(2-ethanephosphonic acid)hydroxylamine, N-sec-butyl-N-(2-ethanesulfonic acid)hydroxylamine, N,N-bis(sec-butylcarboxylic acid)hydroxylamine, N-methyl-N-(p-carboxylbenzyl)hydroxylamine, N-isopropyl-N-(p-carboxylbenzyl)hydroxylamine, N,N-bis(p-carboxylbenzyl)hydroxylamine, N-methyl-N-(p-carboxyl-m-methylbenzyl)hydroxylamine, N-isopropyl-N-(p-sulfobenzyl)hydroxylamine, N-ethyl-N-(p-phosphonobenzyl)hydroxylamine, N-isopropyl-N-(2-carboxymethylene-3-propionic acid)hydroxylamine, N-isopropyl-N-(2-carboxyethyl)hydroxylamine, N-isopropyl-N-(2,3-dihydroxypropyl)hydroxylamine, and alkali metal salts thereof. Other useful antioxidants are described in U.S. Pat. No. 5,508,155 (Marrese et al) and U.S. Pat. No. 5,554,493 (Perry et al), both incorporated herein by reference.

The hydroxylamine derivatives described herein as useful antioxidants can be readily prepared using various published procedures, such as those described in U.S. Pat. No. 3,287,125, U.S. Pat. No. 3,778,464, U.S. Pat. No. 5,110,985, U.S. Pat. No. 5,262,563, and recently allowed U.S. Ser. No. 08/569,643 (filed Dec. 8, 1995, by Burns et al), all incorporated herein by reference for the synthetic methods.

The organic antioxidant described herein is included in the color developer in an amount or at least about 0.001 mol/l, and in a preferred amount of from about 0.001 to about 0.5 mol/l. A most preferred amount is from about 0.005 to about 0.5 mol/l. More than one organic antioxidant can be used in the same color developer if desired.

The duplitized elements described herein are typically exposed to suitable radiation to form a latent image and then photographically processed to form a visible dye image. Processing firstly includes the step of color development as described above to reduce developable silver halide and to oxidize the color developing agent. Oxidized color developing agent in turn reacts with a color-forming coupler to yield a dye.

Optionally but preferably, before the scanning step, partial or total removal of silver and/or silver halide (that is desilvering) is accomplished after color development using conventional bleaching and fixing solutions (i.e., partial or complete desilvering steps), or partial or total fixing only to yield both a dye and silver image. Alternatively, all of the silver and silver halide can be left in the color developed element. One or more conventional washing, rinsing or stabilizing steps can also be used as is known in the art. These steps are typically carried out before scanning and digital manipulation of the density representative signals.

Color development is carried out by contacting the element for up to about 195 seconds with the color developer. Preferably, color development is carried out for from about 5 seconds up to about 120 seconds, more preferably for up to about 90 seconds, even more preferably for up to about 50 seconds, and most preferably for up to about 35 seconds, at a temperature above about 30° C., and generally at from about 37° to about 65° C., and preferably at from about 38° to about 50° C. in suitable processing equipment, to produce the desired developed image.

When the quantity of color masking coupler or incorporated permanent Dmin adjusted dye, or quantities of both, are limited as described above, and a substantially transparent support is used in the element, longer development times can be used. Such longer processing times can be up to about 240 seconds, but are generally up to about 150 seconds, preferably up to about 120 seconds, more preferably up to about 90 seconds. Shorter times can be also be advantageously employed, as described above.

The overall processing time (from development to final rinse or wash) can be from the minimum time necessary to produce an image up to about 7 minutes. Shorter overall processing times, that is, up to about 4 minutes and preferably up to about 3 or even only 90 seconds or less are desired for processing photographic color elements according to this invention.

Processing according to the present invention can be carried out using conventional deep tanks holding processing solutions or automatic processing machines. Alternatively, it can be carried out using what is known in the art as "low volume thin tank" processing systems, or LVTT, which have either a rack and tank or automatic tray design. Such processing methods and equipment are described for example, in U.S. Pat. No. 5,436,118 (Carli et al) and publications noted therein.

Photographic processing of the elements can also be carried out using the method and apparatus designed for processing a film in a cartridge, as described for example in U.S. Pat. No. 5,543,882 (Pagano et al).

Alternatively, the elements can be processed, that is developed and optionally desilvered by applying viscous solutions directly to the film surface as known in the art.

The residual error in photographic responses of photographic elements that are photographically processed as described above, is corrected by transforming the photographic color negative image to density representative digital signals and applying correction values to those digital signals. The term "correction value" is taken to refer to a broad range of mathematical operations that include, but are not limited to, mathematical constants, matrices, linear and non-linear mathematical relationships, and single and multi-dimensional look-up-tables (LUT's).

The term "density representative digital signals" refers to the electronic record produced by scanning a photographic image point-by-point, line by-line, or frame-by-frame, and measuring the transmission of light beams, that is blue, green and red scanning beams that are modulated by the yellow, magenta and cyan dyes in the film negative. In a variant color scanning approach, the blue, green and red scanning beams are combined into a single white scanning beam that is modulated by the dyes, and is read through red, green and blue filters to create three separate digital records. Scanning can be carried out using any conventional scanning device.

In a preferred embodiment, a transmission scanning device, or scanner, is employed in scanning the duplitized elements described herein. Such a scanning device employs a light source, one or more light sensitive photoelectronic devices and a holder to position the element to be scanned between the light source and a light sensitive photoelectronic device. In positioning the duplitized elements in scanner, the duplitized element should be oriented such that specific color layers are closer to the light sensitive photoelectronic device than is the support. Preferably the color recording units derived from at least one red light sensitive emulsion layer and at least one green light sensitive emulsion layer should be positioned closer to the light sensitive photoelectronic device than is the support. This positioning ensures that the color layers most important for image sharpness are scanned in an optically preferred manner. Moreover, whatever the orientation of the exposed and chemically processed film relative to the scanning beam, it can be advantageous to adjust the focus of the scanning beams on the red and green sensitive layers. This focusing ensures that the color layers most important for image sharpness are scanned in an optically preferred manner.

The digital records produced by image dye modulation can then be read into any convenient memory medium (for example, an optical disk) for future digital manipulation or used immediately to produce a corrected digital record capable of producing a display image having desired aim color and tone scale reproduction. The aim color and tone scale reproduction may differ for a given photographic film image or operator. The advantage of the invention is that whatever the "aim", it can be readily achieved using the present invention.

The corrected digital signals (that is, digital records) can be also be forwarded to an output device to form the display image. The output device may take a number of forms such as a silver halide film or paper writer, thermal printer, electrophotographic printer, ink-jet printer, CRT display, CD disc or other type of storage or output display device.

In one embodiment of this invention, the density representative digital signals obtained from scanning the rapidly processed film ($R_{Ti}$, $G_{Ti}$, $B_{Ti}$) are compared with the density representative digital signals ($R_{Oi}$, $G_{Oi}$, $B_{Oi}$) obtained from standard processing of a conventional film having identical exposures and identical spectral sensitivities, and a correction factor is determined.

In its simplest form, the correction factor can be derived from two exposures that are selected to exceed the minimum exposure required to produce a density above Dmin and are less than the minimum exposure required to achieve Dmax. Preferably, these exposures are selected to be as different as possible while falling within the region that exhibits a monotonic and preferably linear density response to log exposure. More preferably, the exposures are also neutral. Based on the density representative digital signals obtained for the two exposures in both the rapidly processed element according to this invention, and the standard temperature and time processed element, a simple gamma correction factor may be obtained.

Equations 1–3 below are used to calculate the correction factor for the red, green and blue color records respectively:

$$\Delta\gamma_R = \frac{R_{Oi_H} - R_{Oi_L}}{R_{Ti_H} - R_{Ti_L}} \quad (1)$$

$$\Delta\gamma_G = \frac{G_{Oi_H} - G_{Oi_L}}{G_{Ti_H} - G_{Ti_L}} \quad (2)$$

-continued $$\Delta\gamma_B = \frac{B_{Oi_H} - B_{Oi_L}}{B_{Ti_H} - B_{Ti_L}} \quad (3)$$

In the above equations, the subscript H and L refer to the high and low exposure levels respectively. In this approach, the density representative digital signals for the rapidly processed negative ($R_{Ti}$, $G_{Ti}$, $B_{Ti}$) are multiplied by ($\Delta\gamma_R$, $\Delta\gamma_G$, $\Delta\gamma_B$) to obtain the corrected density representative signals ($R_{Pi}$, $G_{Pi}$, $B_{Pi}$).

An improved correction factor can be obtained by comparing additional density representative digital signals over a broad range of exposures. Either a set of three (3) one-dimensional look up tables could be derived or, to achieve additional accuracy, a multidimensional look-up table could be used. In practice these approaches would use the density representative digital signal(s) ($R_{Ti}$, $G_{Ti}$, $B_{Ti}$) for each pixel of an image as an index into the look-up tables to find a new density representative signal(s) ($R_{Pi}$, $G_{Pi}$, $B_{Pi}$) that would more closely match that set of density representative digital signals ($R_{Oi}$, $G_{Oi}$, $B_{Oi}$) which would be achieved by a conventional element using a standard process.

Another variant of this approach would be to calculate the functional relationship between ($R_{Ti}$, $G_{Ti}$, $B_{Ti}$) and ($R_{Oi}$, $G_{Oi}$, $B_{Oi}$) as $$f((R_{Oi}, G_{Oi}, B_{Oi})) = g((R_{Ti}, G_{Ti}, B_{Ti}))$$

and to use this equation to calculate corrected density representative digital signals ($R_{Pi}$, $G_{Pi}$, $B_{Pi}$) which more closely match that set of density representative digital signals ($R_{Oi}$, $G_{Oi}$, $B_{Oi}$) which would be achieved by a conventional negative in standard process. Additional variations on this approach could include a matrix, derived by regressing the density representative digital signals achieved by the rapidly processed, duplitized negative ($R_{Ti}$, $G_{Ti}$, $B_{Ti}$) and the desired density representative digital signals obtained from a conventional element given a standard process, ($R_{Oi}$, $G_{Oi}$, $B_{oi}$). The matrix could also be used in combination with a set of look-up tables. The corrected density representative digital signals ($R_{Pi}$, $G_{Pi}$, $B_{Pi}$) achieved by these approaches could then be further manipulated and/or enhanced digitally, displayed on a monitor, transmitted to a hardcopy device, or stored for use at a later date.

In another embodiment of the invention, the density representative digital signals from a rapidly processed film ($R_{Ti}$, $G_{Ti}$, $B_{Ti}$) are obtained for a well manufactured, correctly stored and processed element exposed to a series of patches that differ in color and intensity, and are stepped in intensity over the exposure scale, these density representative digital signals are used in combination with the exposure information for the different patches to generate an interimage correction matrix ($MAT_{ii}$).

$$MAT_{ii} = \begin{vmatrix} a_1 & a_4 & a_5 \\ a_7 & a_2 & a_6 \\ a_8 & a_9 & a_3 \end{vmatrix}$$

This matrix describes the interaction between the three color records where development in one color record can influence development in one or both of the other color records. These types of interactions are well known in the photographic art and are the result of both undesired chemical interactions during development and deliberate chemical and optical interactions designed to influence the overall color reproduction of the element. The inverse of this matrix $(MAT_{ii})^{-1}$, in combination with the density representative digital signal ($R_{Ti}$, $G_{Ti}$, $B_{Ti}$) of the rapidly processed duplitized element useful in this invention, can be used to calculate a channel independent density representative digital signals ($R_{Ci}$, $G_{Ci}$, $B_{Ci}$) representative of those densities that would have been obtained for the particular exposure if there were no interactions between layers:

$$\begin{bmatrix} R_{ci} \\ G_{ci} \\ B_{ci} \end{bmatrix} = (MAT_{ii})^{-1} \times \begin{bmatrix} R_{Ti} \\ G_{Ti} \\ B_{Ti} \end{bmatrix}$$

The red, green and blue channel independent density representative digital signals ($R_{Ci}$, $G_{Ci}$, $B_{Ci}$) are then converted to log (exposure or E) representative digital signals ($R_{LE}$, $G_{LE}$, $B_{LE}$) by the use of three (3), one dimensional look-up tables. The recorded image is then in a form that is independent of the chemical processing.

The log (exposure) representative signals can now be processed in a variety of ways. They can be processed so as to achieve the color density representative digital signals ($R_{Oi}$, $G_{Oi}$, $B_{Oi}$) which would have been achieved by a well manufactured, correctly stored and processed conventional element having the same spectral sensitivities that has been given identical exposures and processed in a standard process. Alternatively, those signals can be processed to achieve the density representative digital signals that would have been obtained for an alternative photographic element type that has been given the same exposures and processed through a standard temperature and standard time process. The methods for these corrections include, but are not limited to, mathematical constants, linear and non-linear mathematical relationships, and look-up tables (LUT's).

It is important to remember that while the images are in the digital form the image processing is not limited to the color and tone scale corrections described above. While the image is in this form, additional image manipulation may be used including, but not limited to, standard scene balance algorithms (to determine printing corrections based on the densities or one or more areas within the negative), sharpening via convolution or unsharp masking, red-eye reduction and grain-suppression. Moreover the image may be artistically manipulated, zoomed, cropped, combined with additional images, or other manipulations known in the art. Once the image has been corrected and any additional image processing and manipulation has occurred, the image may be written to a variety of output devices including, but not limited to, silver-halide film or paper writers, thermal printers, electrophotographic printers, ink-jet printers, display monitors, CD disks and other types of storage and display devices. The display image can be recorded or used, if desired, in a display material which includes but it is not limited to, a color print, a color slide, a motion picture print, an advertising display print, or an advertising display transparency, as would be readily understood in the art.

Thus, the method of this invention can include any one or combination of the following additional steps:

displaying the digital record on a screen, digitally writing the digital record to a viewable medium, digitally transmitting the digital record electronically, storing the digital record in digital form, storing the digital record in analog form, or digitally writing the digital record to a silver halide display element (such as a color photographic paper).

The following examples illustrate the practice of this invention. They are not intended to be exhaustive of all possible variations of the invention. Parts and percentages are by weight unless otherwise indicated.

Photographic Sample 1

Photographic Sample 1, a duplitized multilayer, multicolor light sensitive color negative photographic element useful in this invention, was prepared by applying the following layers to a transparent support of cellulose triacetate having a thickness of about 120 μm. The silver halide coverages (in silver) and the quantities of other materials are given in grams per square meter.

On Side-1 of the support, in order from the support:

Layer 1-1 {Underlayer}: SOL-1 at 0.011 g, SOL-2 at 0.011 g, and gelatin at 1.6 g.

Layer 1-2 {Lowest Sensitivity Red Sensitive Layer}: Red sensitive silver chloride <100>-faced tabular emulsion, average equivalent circular diameter 0.6 μm, average thickness 0.06 μm at 0.43 g, C-1 at 0.501 g, D-2 at 0.009 g, D-3 at 0.003 g, ST-1 at 0.011 g, B-1 at 0.043 g, and gelatin at 1.18 g.

Layer 1-3 {Medium Sensitivity Red Sensitive Layer}: Red sensitive silver chloride <100>-faced tabular emulsion, average equivalent circular diameter 0.9 μm, average grain thickness 0.09 μm at 0.22 g, red sensitive silver chloride <100>-faced tabular emulsion, average equivalent circular diameter 1.3 μm, average grain thickness 0.12 μm at 0.22 g, C-1 at 0.161 g, D-2 at 0.006 g, D-3 at 0.002 g, ST-1 at 0.011 g, and gelatin at 0.43 g.

Layer 1-4 {Highest Sensitivity Red Sensitive Layer}: Red sensitive silver chloride <100>-faced tabular emulsion, average equivalent circular diameter 3.0 μm, average grain thickness 0.14 μm at 0.70 g, C-4 at 0.108 g, D-2 at 0.004 g, D-3 at 0.001 g, ST-1 at 0.011 g, and gelatin at 1.28 g.

Layer 1-5 {Interlayer}: ST-2 at 0.11 g with 0.75 g of gelatin.

Layer 1-6 {Lowest Sensitivity Green Sensitive Layer}: Green sensitive silver chloride <100>-faced tabular emulsion, average equivalent circular diameter 0.6 μm, average grain thickness 0.06 μm at 0.161 g, green sensitive silver chloride <100>-faced tabular emulsion, average equivalent circular diameter 0.9 μm, average grain thickness 0.09 μm at 0.161 g, C-5 at 0.473 g, D-2 at 0.022 g, D-4 at 0.003 g, ST-1 at 0.044 g, and gelatin at 1.18.

Layer 1-7 {Medium Sensitivity Green Sensitive Layer}: Green sensitive silver chloride <100>-faced tabular emulsion, average equivalent circular diameter 0.9 μm, average grain thickness 0.09 μm at 0.161 g, green sensitive silver chloride <100>-faced tabular emulsion, average equivalent circular diameter 1.4 μm, average grain thickness 0.14 μm at 0.215 g, C-5 at 0.150 g, D-2 at 0.0065 g, D-4 at 0.002 g, ST-1 at 0.044 g, and gelatin at 0.43 g.

Layer 1-8 {Highest Sensitivity Green Sensitive Layer}: Green sensitive silver chloride <100>-faced tabular emulsion, average equivalent circular diameter 2.8 μm, average grain thickness 0.14 μm at 0.70 g, C-5 at 0.140 g, D-2 at 0.0043 g, D-4 at 0.001 g, ST-1 at 0.044 g, and gelatin at 1.29 g.

Layer 1-9 {Protective Layer-1}: DYE-4 at 0.086 g, DYE-5 at 0.086 g, and gelatin at 0.97 g.

Layer 1-10 {Protective Layer-2}: silicone lubricant at 0.04 g, tetraethylammonium perfluorooctane sulfonate, silica at 0.29 g, anti-matte polymethylmethacrylate beads at 0.11 g, soluble anti-matte polymethylmethacrylate beads at 0.005 g, and gelatin at 0.89 g.

On Side-2 of the support in order from the support:

Layer 2-1 {Underlayer}: 1.6 g gelatin.

Layer 2-2 {Highest Sensitivity Blue Sensitive Layer}: Blue sensitive silver chloride <100>-faced tabular emulsion with average equivalent circular diameter of 3.3 μm and average grain thickness of 0.15 μm at 86 g, C-7 at 0.269 g, D-5 at 0.011 g, D-4 at 0.001 g, ST-1 at 0.011 g, and gelatin at 0.81 g.

Layer 2-3 {Lowest Sensitivity Blue Sensitive Layer}: Blue sensitive silver chloride <100>-faced tabular emulsion with average equivalent circular diameter of 0.6 μm and average grain thickness of 0.06 μm at 0.108 g, and a blue sensitive silver chloride <100>-faced tabular emulsion with average equivalent circular diameter of 1.0 μm and average grain thickness of 0.1 μm at 0.108 g, C-7 at 0.861 g, D-4 at 0.003 g, D-5 at 0.043 g, ST-1 at 0.011 g, and gelatin at 0.73 g.

Layer 2-4 {Antihalation and Protective Layer-3}: DYE-4 at 0.086 g, DYE-1 at 0.108 g, and gelatin at 1.02 g.

Layer 2-5 {Protective Layer-4}: silicone lubricant at 0.04 g, tetraethylammonium perfluorooctane sulfonate, silica at 0.29 g, anti-matte polymethylmethacrylate beads at 0.11 g, soluble anti-matte polymethylmethacrylate beads at 0.005 g, and gelatin at 0.89 g.

Photographic Sample 1 was hardened at coating with about 2% by weight to total gelatin of hardener. The organic compounds were used as emulsions optionally containing coupler solvents, surfactants and stabilizers or used as solutions both as commonly practiced in the art. The coupler solvents employed in this photographic sample included: tricresylphosphate, di-n-butyl phthalate, N,N-diethyl lauramide, N,N-di-n-butyl lauramide, 2,4-di-t-amylphenol, N-butyl-N-phenyl acetamide, and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, 1,3-butanediol, 4-hydroxy-6-methyl-1,3,3a,7-tetraazaindene, 5-bromo-4-hydroxy-6-methyl-1,3,3a,7-tetraazaindene, lanothane and disodium-3,5-disulfocatechol. Silver halide emulsions employed in this sample were chemically and spectrally sensitized and comprised a silver chloride region with a surrounding iodide band, as described in U.S. Pat. No. 5,314,798 (Brust), the disclosure of which are incorporated by reference. The individual emulsions comprised about 0.55 mol % iodide based on silver. Other surfactants, coating aids, scavengers, soluble absorber dyes and stabilizers as well as various iron, lead, gold, platinum, palladium, iridium and rhodium salts were optionally added to the various emulsions and layers of this sample as is commonly practiced in the art so as to provide good preservability, processability, pressure resistance, anti-fungal and antibacterial properties, antistatic properties and coatability.

The total dry thickness of the applied layers on Side-1 of the support was about 14 μm while the total dry thickness of all of the applied layers on Side-2 of the support was about 7 μm.

Photographic Sample 1 contained less than about 0.2 mmol/m$^2$ of color masking coupler and less than about 0.1 mmol/m$^2$ of dyes that functioned as incorporated permanent Dmin adjusting dye.

Photographic Sample 2

Photographic Sample 2 was like Photographic Sample 1 except that the blue light sensitive high silver chloride tabular grain emulsions in layers 2-3, and 2-4 were replaced by equal quantities of optimally sensitized emulsions sensitized AgIBr tabular grain emulsions. These AgIBr emulsions comprised about 96 mol % silver bromide and about 4 mol % silver iodide, and were generally prepared using the procedures described by U.S. Pat. No. 4,439,520 (Kofron et al). These emulsions were further characterized as comprising a AgIBr core with a surrounding iodide band or shell structure similar to that employed in the tabular AgCl emulsions useful in the practice of this invention.

Photographic Sample 2 contained less than about 0.2 mmol/m$^2$ of color masking coupler and less than about 0.1 mmol/m$^2$ of dyes that functioned as incorporated permanent Dmin adjusting dyes.

Photographic Sample 3

Photographic Sample 3 was like Photographic Sample 1 except that all of the light sensitive high silver chloride tabular grain emulsions in emulsion layers were replaced by equal quantities of optimally sensitized emulsions sensitized AgIBr tabular grain emulsions. These AgIBr emulsions comprised about 96 mol % silver bromide and about 4 mol % silver iodide, and were generally prepared using the procedures described by U.S. Pat. No. 4,439,520 (noted above). These emulsions were further characterized as comprising a AgIBr core with a surrounding iodide band or shell structure similar to that employed in the tabular AgCl emulsions useful in the practice of the invention.

Photographic Sample 3 contained less than about 0.2 mmol/m$^2$ of color masking coupler and less than about 0.1 mmol/m$^2$ of dyes that functioned as incorporated permanent Dmin adjusting dyes.

Photographic Sample 4 (Comparison)

Photographic Sample 4, illustrating the preparation of a typical comparative, non-duplitized, multilayer multicolor light sensitive color negative photographic element (Control A) was prepared by applying the following layers in the given sequence to a transparent support of cellulose triacetate. This element was like Photographic Sample 1 except that all of the sensitized layers were positioned on the same side of the support. Common emulsions and components were employed to prepare both Photographic Sample 1 and Photographic Sample 4.

Layer 1 {Antihalation Layer}: DYE-1 at 0.108 g, DYE-2 at 0.022 g, Dye-3 at 0.086 g, DYE-4 at 0.108 g, SOL-1 at 0.011 g, SOL-2 at 0.011 g, and 1.6 g gelatin.

Layer 2 {Lowest Sensitivity Red Sensitive Layer}: Red sensitive silver chloride <100>-faced tabular emulsion, average equivalent circular diameter 0.6 μm, average thickness 0.06 μm at 0.495 g, C-1 at 0.401 g, D-1 at 0.014 g, D-2 at 0.011 g, D-3 at 0.003 g, C-2 at 0.097 g, C-3 at 0.021 g, ST-1 at 0.011 g, B-1 at 0.043 g, and gelatin at 1.12 g.

Layer 3 {Medium Sensitivity Red Sensitive Layer}: Red sensitive silver chloride <100>-faced tabular emulsion, average equivalent circular diameter 0.9 μm, average grain thickness 0.09 μm at 0.097 g, red sensitive silver chloride <100>-faced tabular emulsion, average equivalent circular diameter 1.3 μm, average grain thickness 0.12 μm at 0.129 g, C-1 at 0.132 g, D-1 at 0.0065 g, D-2 at 0.011 g, D-3 at 0.001 g, C-2 at 0.022 g, C-3 at 0.022 g, ST-1 at 0.011 g, and gelatin at 0.43 g.

Layer 4 {Highest Sensitivity Red Sensitive Layer}: Red sensitive silver chloride <100>-faced tabular emulsion, average equivalent circular diameter 3.0 μm, average grain thickness 0.14 μm at 0.70 g, C-4 at 0.097 g, D-1 at 0.0043 g, D-2 at 0.011 g, D-3 at 0.001 g, C-2 at 0.011 g, ST-1 at 0.011 g, and gelatin at 1.28 g.

Layer 5 {Interlayer}: ST-2 at 0.11 g with 0.75 g of gelatin.

Layer 6 {Lowest Sensitivity Green Sensitive Layer}: Green sensitive silver chloride <100>-faced tabular emulsion, average equivalent circular diameter 0.6 μm, average grain thickness 0.06 μm at 0.269 g, green sensitive silver chloride <100>-faced tabular emulsion, average equivalent circular diameter 0.9 μm, average grain thickness 0.09 μm at 0.107 g, C-5 at 0.473 g, D-1 at 0.012 g, D-2 at 0.022 g, D-4 at 0.003 g, C-6 at 0.097 g, ST-1 at 0.044 g, and gelatin at 1.18.

Layer 7 {Medium Sensitivity Green Sensitive Layer}: Green sensitive silver chloride <100>-faced tabular emulsion, average equivalent circular diameter 0.9 μm, average grain thickness 0.09 μm at 0.086 g, green sensitive silver chloride <100>-faced tabular emulsion, average equivalent circular diameter 1.4 μm, average grain thickness 0.14 μm at 0.172 g, C-5 at 0.140 g, D-1 at 0.0065 g, D-2 at 0.0065 g, D-4 at 0.001 g, C-6 at 0.011 g, ST-1 at 0.044 g, and gelatin at 0.43 g.

Layer 8 {Highest Sensitivity Green Sensitive Layer}: Green sensitive silver chloride <100>-faced tabular emulsion, average equivalent circular diameter 2.8 μm, average grain thickness 0.14 μm at 0.70 g, C-5 at 0.140 g, D-1 at 0.0043 g, D-2 at 0.0043 g, D-4 at 0.001 g, ST-1 at 0.044 g, and gelatin at 1.29 g.

Layer 9 {Interlayer}: ST-2 at 0.11 g with 0.75 g of gelatin.

Layer 10 {Lowest Sensitivity Blue Sensitive Layer}: Blue sensitive silver chloride <100>-faced tabular emulsion with average equivalent circular diameter of 0.6 μm and average grain thickness of 0.06 μm at 0.161 g, and a blue sensitive silver chloride <100>-faced tabular emulsion with average equivalent circular diameter of 1.0 μm and average grain thickness of 0.1 μm at 0.108 g, C-7 at 0.861 g, D-1 at 0.016 g, D-4 at 0.001 g, D-5 at 0.054 g, ST-1 at 0.011 g, and gelatin at 0.83 g.

Layer 11 {Highest Sensitivity Blue Sensitive Layer}: Blue sensitive silver chloride <100>-faced tabular emulsion with average equivalent circular diameter of 3.3 μm and average grain thickness of 0.15 μm at 1.02 g, C-8 at 0.172 g, D-1 at 0.011 g, D-4 at 0.001 g, D-5 at 0.011 g, ST-1 at 0.011 g, and gelatin at 0.81 g.

Layer 12 {Protective Layer-1}: DYE-4 at 0.053 g, DYE-5 at 0.053 g, and gelatin at 0.7 g.

Layer 13 {Protective Layer-2}: silicone lubricant at 0.04 g, tetraethylammonium perfluorooctane sulfonate, silica at 0.29 g, anti-matte polymethylmethacrylate beads at 0.11 g, soluble anti-matte polymethylmethacrylate beads at 0.005 g, and gelatin at 0.89 g.

The total dry thickness of all the applied layers on the support was about 18 μm while the total dry thickness from the innermost face of the sensitized layer closest to the support to the outermost face of the sensitized layer furthest from the support was about 14 μm. Photographic Sample 4 contained more than about 0.2 mmol/m$^2$ of color masking coupler and more than about 0.1 mmol/m$^2$ of dyes that functioned as incorporated permanent Dmin adjusting dyes.

Photographic Sample 5 (Comparison)

Photographic Sample 5, illustrating the preparation of another comparative, nonduplitized multilayer multicolor light sensitive color negative photographic element (Control B) was prepared generally like Photographic Sample 4 except that the masking couplers C-2, C-3 and C-6 and the absorber dyes DYE-2 and DYE-3 were omitted from the sample. This element is thus quite similar to Photographic Sample 1 except for the positioning of all of the sensitized layers on only one side of the support. Photographic Sample 5 contained less than about 0.2 mmol/m$^2$ of color masking coupler and less than about 0.1 mmol/m$^2$ of dyes that functioned as incorporated permanent Dmin adjusting dyes.

Photographic Sample 6 (Comparison)

Photographic Sample 6, illustrating the preparation of still another comparative, nonduplitized multilayer multicolor light sensitive color negative photographic element (Control C) was prepared using the layer order described for Photographic Sample 4. Image dye forming couplers, DIR and BAR couplers, masking couplers and Dmin adjusting dyes were employed. Photographic Sample 6 employed AgIBr tabular grain emulsions, as in Photographic Sample 3. These AgIBr emulsions comprised about 96 mol % silver bromide and about 4 mol % silver iodide, and were generally prepared following the procedures described by U.S. Pat. No. 4,439,520 (noted above). These emulsions were further characterized as comprising a AgIBr core with a surrounding iodide band or shell structure similar to that employed in the tabular AgCl emulsions useful in the practice of the invention.

Photographic Sample 6 contained more than about 0.2 mmol/m$^2$ of color masking coupler and more than about 0.1 mmol/m$^2$ of dyes that functioned as incorporated permanent Dmin adjusting dyes.

Compounds Employed in the Photographic Samples

DYE-1
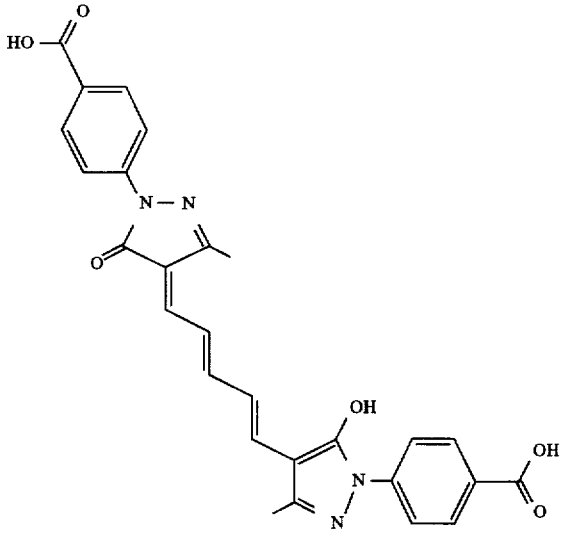
DYE-2
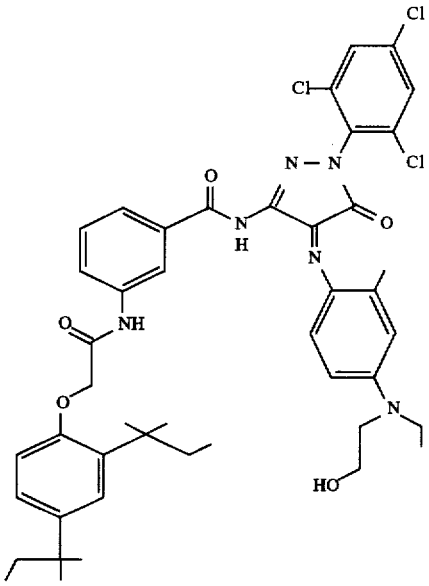
DYE-3
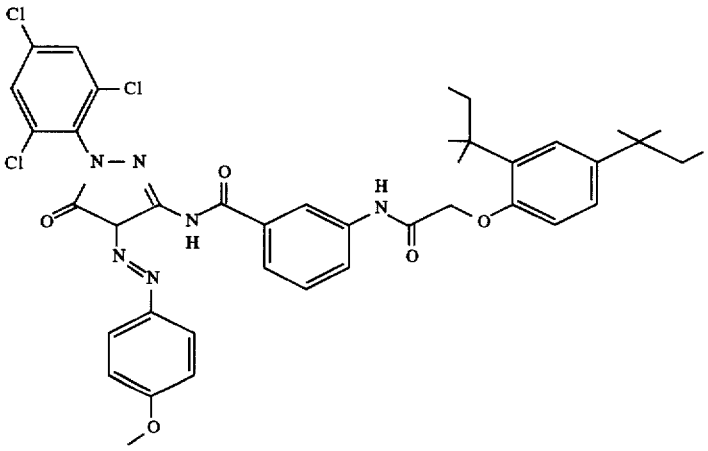

-continued
DYE-4
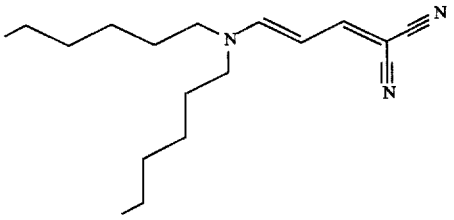
SOL-1
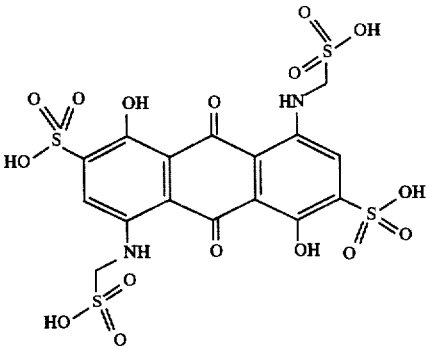
SOL-2
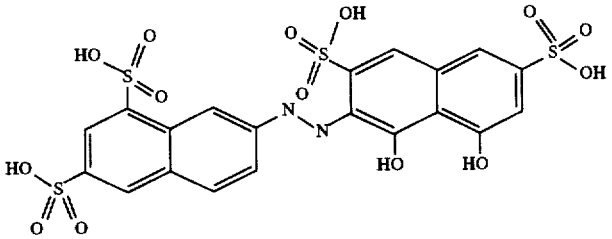
C-1
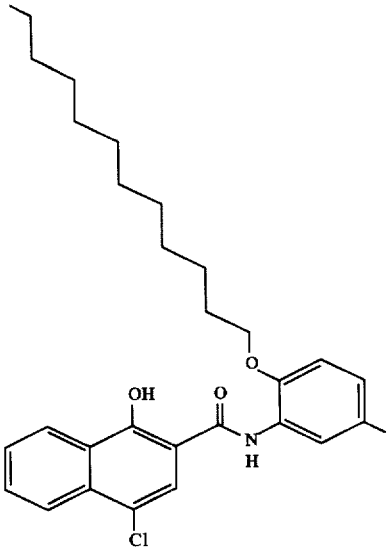

-continued
D-1
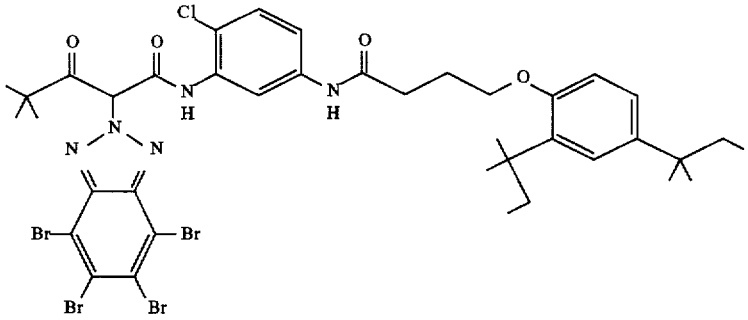
D-2 (mixture of isomers)
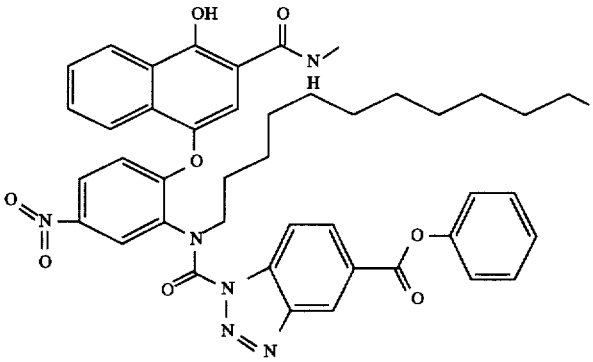
D-3 (mixture of isomers)
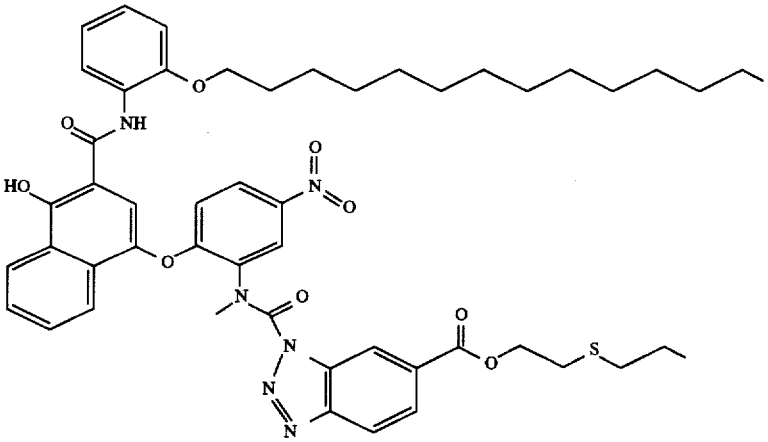
B-1
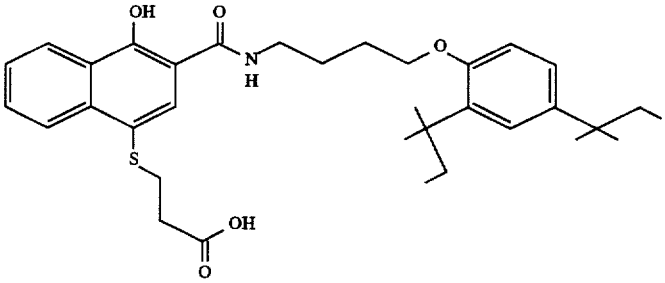

-continued
C-2
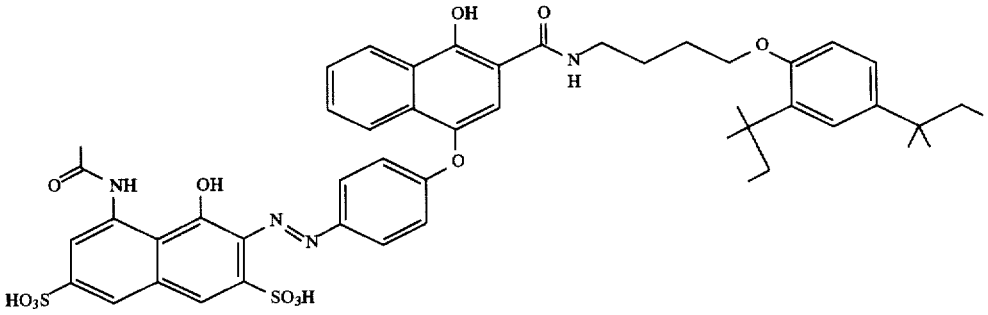
C-3
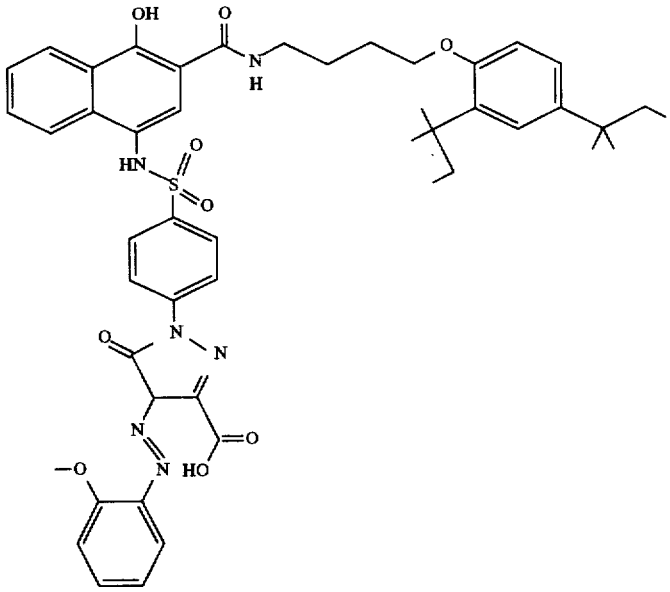
ST-1
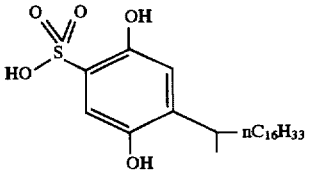
C-4
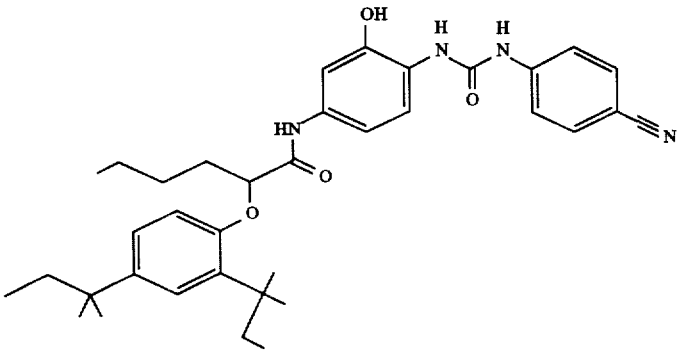

-continued
ST-2
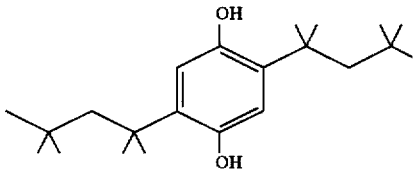
C-5
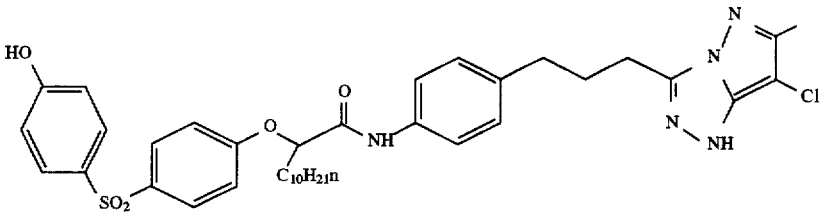
D-4 (mixture of isomers)
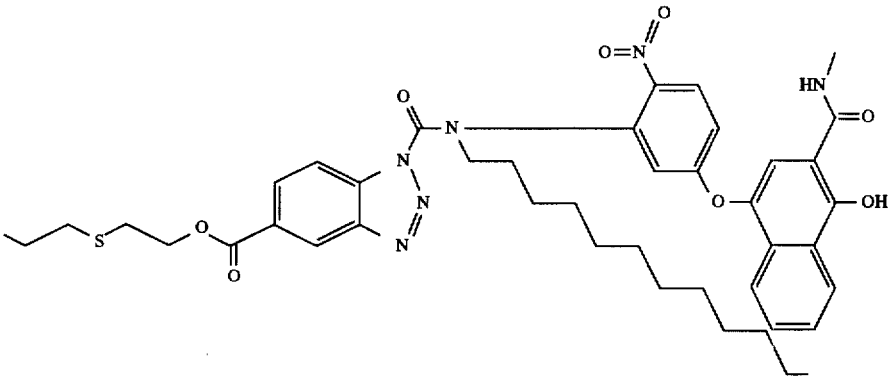
C-6
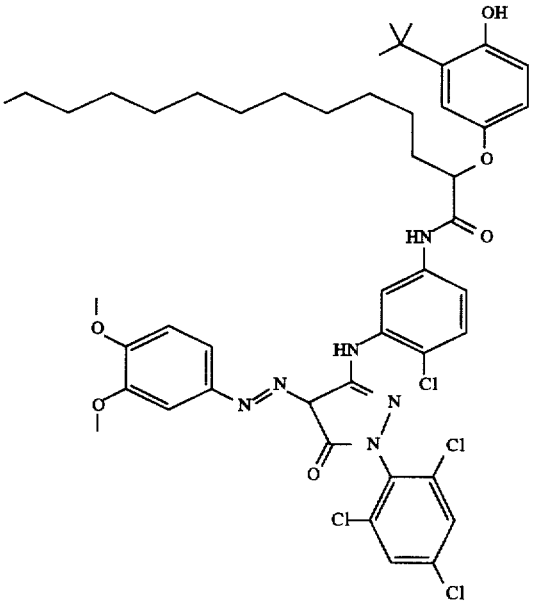

-continued

C-7

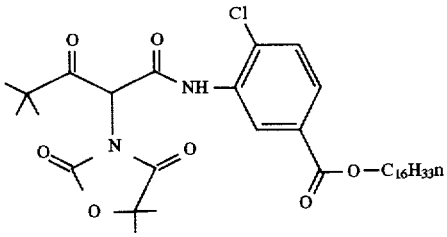

D-5 (mixture of isomers)

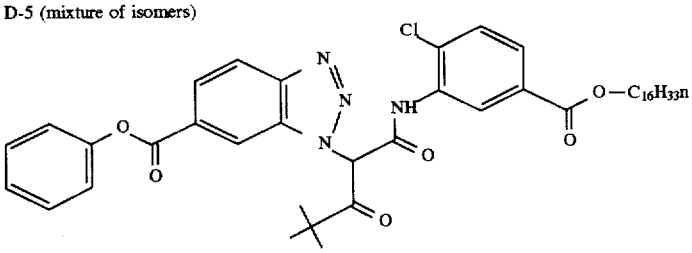

C-8

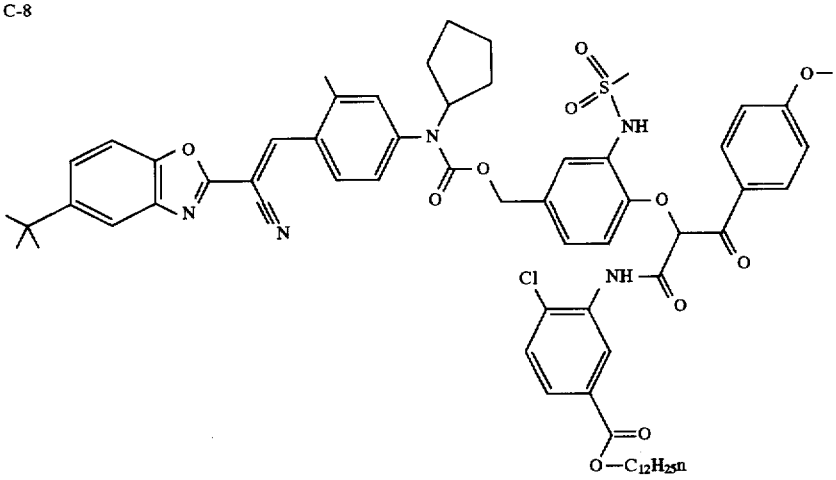

DYE-5

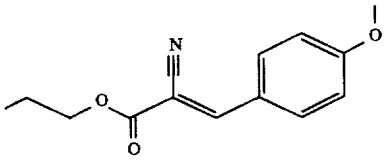

Several color photographic processing solutions were prepared as follows:

Developer I was formulated by adding water, 34.3 g of potassium carbonate, 2.32 g of potassium bicarbonate, 0.38 g of anhydrous sodium sulfite, 2.96 g of sodium metabisulfite, 1.2 mg of potassium iodide, 1.31 g of sodium bromide, 8.43 g of a 40% solution of diethylenetriamine-pentaacetic acid pentasodium salt, 2.41 g of hydroxylamine sulfate, 4.52 g of (N-(4-amino-3-methylphenyl)-N-ethyl-2-aminoethanol) as its sulfuric acid salt and sufficient additional water and sulfuric acid or potassium hydroxide to make 1 liter of solution having a pH of 10.00±0.05 at 26.7° C.

Developer II was formulated by adding water, 320.0 g of potassium carbonate, 32.56 g of anhydrous sodium sulfite, 8.0 g of sodium bromide, 32.0 g of potassium chloride, 28.0 g of diethylenetriamine-pentaacetic acid pentasodium salt, 19.28 g of hydroxylamine sulfate, 80.0 g of (N-(4-amino-3-methylphenyl)-N-ethyl-2-aminoethanol) as its sulfuric acid salt and sufficient additional water and sulfuric acid or potassium hydroxide to make 8 liters of solution having a pH of 10.00±0.05 at 26.7° C.

Developer III was formulated by adding water, 320.0 g of potassium carbonate, 32.56 g of anhydrous sodium sulfite, 20.0 g of sodium bromide, 32.0 g of potassium chloride, 28.0 g of diethylenetramine-pentaacetic acid pentasodium salt, 19.28 g of hydroxylamine sulfate, 120.0 g of (N-(4-amino-3-methylphenyl)-N-ethyl-2-aminoethanol) as its sulfuric acid salt and sufficient additional water and sulfuric acid or potassium hydroxide to make 8 liters of solution having a pH of 10.00±0.05 at 26.7° C.

Developer IV was formulated from 800 ml of water, 11 ml of 100% triethanolamine, 0.25 ml of 30% lithium polystyrene sulfonate, 0.24 g of anhydrous potassium sulfite, 2.3 g of BLANKOPHOR REU brightening agent, 2.7 g of lithium sulfate, 0.8 ml of 60% 1-hydroxyethyl-1,1-diphosphonic acid, 1.8 g of potassium chloride, 0.02 g of potassium bromide, 25 g of potassium carbonate, 6 ml of 85% N,N-diethylhydroxylamine, 4.85 g of N-(4-amino-3-methylphenyl)-N-ethyl-2-aminoethyl-methanesulfonamide as its sesquisulfuric acid monohydrate salt, and sufficient additional water and acid or base to make 1 liter of solution having a pH of 10.12°±0.05° C.

Bleach I was formulated by adding water, 37.4 g of 1,3-propylenediamine tetraacetic acid, 70 g of a 57% ammonium hydroxide solution, 80 g of acetic acid, 0.8 g of 2-hydroxy-1,3-propylenediamine tetraacetic acid, 25 g of ammonium bromide, 44.85 g of ferric nitrate nonahydrate and sufficient water and acid or base to make 1 liter of solution having a pH of 4.75.

Bleach II was formulated by adding to water 113.6 g of 1,3-propylenediamine tetraacetic acid, 51.5 g of acetic acid, 94.7 g of ammonium bromide, and 0.95 g of 2-hydroxy-1,3-propylenediamine tetraacetic acid, 136.9 g of ferric nitrate nonahydrate and sufficient water and ammonium hydroxide to make 1 liter of solution having a pH of 4.5.

Fix I was formulated by adding water, 214 g of a 58% solution of ammonium thiosulfate, 1.29 g of (ethylenedinitrilo)tetraacetic acid disodium salt dihydrate, 11 g of sodium metabisulfite, 4.7 g of a 50% solution of sodium hydroxide and sufficient water and acid or base to make 1 liter of solution having a pH 6.5.

Fix II was formulated by adding water, 194 g of a 58% solution of ammonium thiosulfate, 1.2 g of (ethylenedinitrilo)tetraacetic acid disodium salt dihydrate, 7.94 g of ammonium sulfite, 14 g of sodium sulfite, 138 g of ammonium thiocyanate, 4.78 g of glacial acetic acid and sufficient water and ammonium hydroxide or sulfuric acid to make 1 liter of solution having a pH 6.2.

A Rinse was formulated by adding 0.4 g of 50% ZONYL FSO surfactant in water, 1.6 g of NEODOL 25-7 surfactant, and 5.34 ml of 1.5% Kathon LX biocide in water to sufficient water to make 8 liters of a solution having a pH of about 8.3.

The following photographic processing protocols were used to process various photographic samples:

| STEP | TIME (sec) | SOLUTION | TEMPERATURE |
|---|---|---|---|
| Process A: | | | |
| Develop | 195 | Developer I | 38° C. |
| Bleach | 240 | Bleach I | 38° C. |
| Wash | 180 | Water | 35° C. |
| Fix | 240 | Fixer I | 38° C. |
| Wash | 180 | Water | 35° C. |
| Rinse | 60 | Rinse | 35° C. |
| Rapid Process B: | | | |
| Develop | 90 | Developer I | 38° C. |
| Bleach | 60 | Bleach I | 38° C. |
| Fix | 60 | Fixer I | 38° C. |
| Wash | 60 | Water | 35° C. |
| Rinse | 60 | Rinse | 35° C. |
| Rapid Process C: | | | |
| Develop | 30 | Developer II | 50° C. |
| Bleach | 30 | Bleach II | 50° C. |
| Fix | 30 | Fixer II | 50° C. |
| Wash | 30 | Water | 50° C. |
| Rinse | 10 | Rinse | 50° C. |
| Rapid Process D: | | | |
| Develop | 15 | Developer III | 60° C. |

-continued

| STEP | TIME (sec) | SOLUTION | TEMPERATURE |
|---|---|---|---|
| Bleach | 15 | Bleach II | 60° C. |
| Fix | 15 | Fixer II | 60° C. |
| Wash | 15 | Water | 60° C. |
| Rinse | 10 | Rinse | 60° C. |
| Rapid Process E: | | | |
| Develop | 45 | Developer IV | 38° C. |
| Bleach | 60 | Bleach I | 38° C. |
| Fix | 60 | Fixer I | 38° C. |
| Wash | 60 | Water | 35° C. |
| Rinse | 60 | Rinse | 35° C. |

Processing Example 1

Individual portions of Photographic Samples 1–6 were exposed through a calibrated graduated density test object using a calibrated 1B sensitometer, and each was then processed using Processes A, B, C and D. The Status M density of each resultant step image was determined for red, green and blue light as a function of incident exposure, and the exposure required to enable a density of 0.15 above Dmin in each color recording unit was determined. The photographic sensitivity, or ISO speed, of each element processed in each process was then determined following International Standards Organization procedures. These ISO speeds for each Photographic Sample and Process are listed in the following TABLE I.

TABLE I

| Sample | Coating Structure | Emulsion | Process | Speed |
|---|---|---|---|---|
| 1 | duplitized, low D | AgIC1 | A | 740 |
| 2 | duplitized, low D | AgIC1/AgIBr | A | 877 |
| 3 | duplitized, low D | AgIBr | A | 814 |
| 4 | Control A | AgICl | A | 422 |
| 5 | Control B, low D | AgICl | A | 448 |
| 6 | Control C | AgIBr | A | 414 |
| 1 | duplitized, low D | AgICl | B | 388 |
| 2 | duplitized, low D | AgICl/AgIBr | B | 481 |
| 3 | duplitized, low D | AgIBr | B | 350 |
| 4 | Control A | AgICl | B | 181 |
| 5 | Control B, low D | AgICl | B | 279 |
| 6 | Control C | AgIBr | B | 91 |
| 1 | duplitized, low D | AgICl | C | 704 |
| 2 | duplitized, low D | AgICl/AgIBr | C | 449 |
| 3 | duplitized, low D | AgIBr | C | 152 |
| 4 | Control A | AgICl | C | 296 |
| 5 | Control B, low D | AgICl | C | 277 |
| 6 | Control C | AgIBr | C | 85 |
| 1 | duplitized, low D | AgICl | D | 508 |
| 2 | duplitized, low D | AgICl/AgIBr | D | 432 |
| 3 | duplitized, low D | AgIBr | D | 260 |
| 4 | Control A | AgICl | D | 157 |
| 5 | Control B, low D | AgICl | D | 186 |
| 1 | duplitized, low D | AgICl | E | 331 |
| 2 | duplitized, low D | AgICl/AgIBr | E | 230 |
| 3 | duplitized, low D | AgIBr | E | 32 |
| 5 | Control B, low D | AgICl | E | 102 |
| 6 | Control C | AgIBr | E | <1 |

In TABLE I, "low D" indicates a limited amount of permanent Dmin adjusting dye and color coupler. The duplitized films surprisingly exhibited improved photographic sensitivity in each Process.

Processing Example 2

As noted above, there are a number of ways to derive the correction factor to provide color and tone-scale corrected images from a processed photographic element. This example is one method of doing so, and is not intended to limit the means that may be used to calculate the correction factor. Photographic Samples 1–6 were given a series of known exposures, including neutral patches of varying densities, and a variety of combinations of red, green, and blue exposures. The exposed films were then processed through one or more of Processes A–D noted above, to form a negative image having cyan, magenta, and yellow dye densities which vary in an imagewise fashion. Once a negative image had been obtained for a particular film-process combination, a digital representation of the negative was obtained by means of an optoelectronic scanner. The details for creating this digital representation are well known in the art. For duplitized elements, it is preferable to focus the scanner (using a focusing device) on the light sensitive layers that are closest to the light source used in the exposure step. Generally, these layers are the red and/or green light sensitive layers. The digital scanner density representative signals for each pixel may be described as $R_{SD}$, $G_{SD}$, $B_{SD}$.

In non-duplitized color negative films (such as Controls A–C), there are significant interactions between the different color records where the development in one color record may affect the density achieved in the other color records. A matrix describing these interactions between the color records may be derived from the digital scanner density representative signals ($R_{SD}$, $G_{SD}$, $B_{SD}$) of the various patches and the exposures which generated said patches using standard regression techniques. This matrix may be thought of as describing the transformation of digital channel independent density signals ($R_{CI}$, $G_{CI}$, $B_{CI}$) (those densities that would have formed if there were no interactions between the color records) to the digital scanner density representative signals ($R_{SD}$, $G_{SD}$, $B_{SD}$) (the densities that formed including the interactions between the different color records). The inverse of this matrix was also calculated. This second matrix converts digital scanner density representative signals ($R_{SD}$, $G_{SD}$, $B_{SD}$) to digital channel independent density representative signals ($R_{CI}$, $G_{CI}$, $B_{CI}$).

As an example, when Photographic Sample 6 (Control C) was processed using Process A, the following Equation I describes the calculation of resulting channel independent densities. While the matrix shown is a 3×3 matrix, more precision could be obtained with a higher order matrix or a multidimensional lookup table.

Equation I $$\begin{bmatrix} R_{CI} \\ G_{CI} \\ B_{CI} \end{bmatrix} = \begin{bmatrix} 0.866 & 0.093 & 0.041 \\ 0.029 & 0.946 & 0.025 \\ -0.016 & -0.047 & 1.063 \end{bmatrix} \begin{bmatrix} R_{SD} \\ G_{SD} \\ B_{SD} \end{bmatrix}$$

The digital scanner density representative signals ($R_{SD}$, $G_{SD}$, $B_{SD}$), obtained for a broad range of neutral exposures were combined with their known exposures to describe a film characteristic curve. The digital scanner density representative signals ($R_{SD}$, $G_{SD}$, $B_{SD}$) were then converted to digital channel independent density representative signals ($R_{CI}$, $G_{CI}$, $B_{CI}$) using Equation I. This is desirable because there is a one to one relationship between the log Exposure and the digital channel independent density representative signals ($R_{CI}$, $G_{CI}$, $B_{CI}$). The digital channel independent density signals ($R_{CI}$, $G_{CI}$, $B_{CI}$) vs. log exposure curves can be thought of as a series of one-dimensional look up tables that convert digital channel independent representative signals ($R_{CI}$, $G_{CI}$, $B_{CI}$) to digital log exposure representative signals ($R_{LE}$, $G_{LE}$, $B_{LE}$). All of the pieces are now in place to convert the measured digital scanner density representative signals ($R_{SD}$, $G_{SD}$, $B_{SD}$) of an image to the digital log exposure representative signals ($R_{LE}$, $G_{LE}$, $B_{LE}$) of an image. The digitized image is now in a form that is independent of the film characteristic curve and interimage produced by the film-process combination. The means for producing desirable output from scene log exposures is well known in the field. The digital log exposure representative signals ($R_{LE}$, $G_{LE}$, $B_{LE}$) can now be transformed in a variety of ways to produce desirable output. If the desire is to explicitly match the image that would have been produced had the image been captured on an aim film and processed through standard FLEXICOLOR C41™ processing chemistry, the calculated digital log exposure representative signals ($R_{LE}$, $G_{LE}$, $B_{LE}$) can be transformed through a model of the interlayer interactions and tone scale associated with the desired film-process combination resulting in a description of the image in terms of aim film density representative signals ($R_{AIM}$, $G_{AIM}$, $B_{AIM}$). These aim film density representative signals can then be processed as appropriate for the desired output device.

Photographic Sample 6 was also exposed to an additional series of neutral and colored patches. This film was then processed using Process A to form a negative image having cyan, magenta, and yellow dye densities which vary in an imagewise fashion. This negative image was used to make an optical print in such a way that a specific neutrally exposed patch produced a Status A density of 0.7±0.03 in all 3 color records. The Status A densities were measured for the set of patches. This film-process combination is used as the "check" position in TABLE II hereinbelow, describing the color/tone scale reproduction for the different film-process combinations optically printed on KODAK EDGE™ Color Paper.

The negative image was than scanned by means of an optoelectronic scanner to obtain a digital representation of the image. The digital scanner density representative signals ($R_{SD}$, $G_{SD}$, $B_{SD}$) were then processed as described above to obtain the digital log exposure representative signals ($R_{LE}$, $G_{LE}$, $B_{LE}$). These signals were then processed through an aim film-paper model to produce an output image having desirable color and tone scale reproduction. Again, this was done in such a way that the selected neutrally exposed patch produced a specified set of matched Status A densities. The Status A densities were obtained for the set of patches. These data were used as the check position in TABLE III hereinbelow which describes the digitally corrected color and tone scale reproduction of the different film-process combinations.

Processing Example 3

Photographic Sample 1 was exposed to the series of neutral and color patches and then processed using Process B. The resulting negative image was scanned and a digital correction factor derived in the manner described above. For this particular film-process combination there were, as expected, differences in the chemical interactions between the various color records and differences in the film's characteristic curve compared to that of the check position described above. Equation II below describes the conversion of digital scanner density representative signals ($R_{SD}$, $G_{SD}$, $B_{SD}$) to digital channel independent representative signals ($R_{CI}$, $G_{CI}$, $B_{CI}$) for this film-process combination.

Equation II $$\begin{bmatrix} R_{CI} \\ G_{CI} \\ B_{CI} \end{bmatrix} = \begin{bmatrix} 0.989 & -0.031 & 0.042 \\ -0.005 & 1.062 & -0.057 \\ -0.121 & -0.294 & 1.415 \end{bmatrix} \begin{bmatrix} R_{SD} \\ G_{SD} \\ B_{SD} \end{bmatrix}$$

Photographic Sample 1 was also exposed to an additional series of neutral and colored patches. The film was then processed using Process B to form a negative image having cyan, magenta, and yellow dye densities which vary in an imagewise fashion. This negative image was used to make an optical print in such a way that a specific, neutrally exposed, patch produced Status A densities of 0.7±0.03 in all 3 color records. The Status A densities were measured for the set of patches and the differences in the Status A densities of this film-process combination compared to those of the check film-process combination (as described Processing Example 2) are tabulated in TABLE II below.

A digital representation of this negative image was obtained by means of an optoelectronic scanner. The digital scanner density representative signals ($R_{SD}$, $G_{SD}$, $B_{SD}$) were then processed as described above to obtain the digital log exposure representative signals ($R_{LE}$, $G_{LE}$, $B_{LE}$). These signals were then processed through an aim film-paper model to produce an output image having the desired color and tone scale reproduction. This was done in such a way that the selected, neutrally exposed, patch produced a specified set of matched Status A densities. The Status A densities were obtained for the set of patches and the differences in the digitally corrected Status A densities of this film-process combination compared to those of the check film-process are tabulated in TABLE III below.

Processing Example 4

Photographic Sample 2 was exposed to the series of neutral and color patches and then processed using Process B. The resulting negative image was scanned and a digital correction factor derived in the manner described above. For this particular film-process combination there were, as expected, differences in the chemical interactions between the various color records and differences in the film's characteristic curve compared to that of the check position described in Processing Example 2. Equation III below describes the conversion of digital scanner density representative signals ($R_{SD}$, $G_{SD}$, $B_{SD}$) to digital channel independent representative signals ($R_{CI}$, $G_{CI}$, $B_{CI}$) for this film-process combination.

Equation III $$\begin{bmatrix} R_{CI} \\ G_{CI} \\ B_{CI} \end{bmatrix} = \begin{bmatrix} 0.896 & 0.001 & 0.104 \\ -0.024 & 1.088 & -0.064 \\ -0.097 & -0.226 & 1.322 \end{bmatrix} \begin{bmatrix} R_{SD} \\ G_{SD} \\ B_{SD} \end{bmatrix}$$

Photographic Sample 2 was also exposed to an additional series of neutral and colored patches. The film was then processed using Process B to form a negative image having cyan, magenta, and yellow dye densities which vary in an imagewise fashion. This negative image was used to make an optical print in such a way that a specific, neutrally exposed, patch produced Status A densities of 0.7±0.03 in all 3 color records. The Status A densities were measured for the set of patches and the differences in the Status A densities of this film-process combination compared to those of the check film-process combination (as described in Processing Example 2) are tabulated in TABLE II below.

A digital representation of this negative image was obtained by means of an optoelectronic scanner. The digital scanner density representative signals ($R_{SD}$, $G_{SD}$, $B_{SD}$) were then processed as described above to obtain the digital log exposure representative signals ($R_{LE}$, $G_{LE}$, $B_{LE}$). These were then processed through an aim film-paper model to produce an output image having the desired color and tone scale reproduction. This was done in such a way that the selected, neutrally exposed, patch produced a specified set of matched Status A densities. The Status A densities were obtained for the set of patches and the differences in the digitally corrected Status A densities of this film-process combination compared to those of the check film-process combination are tabulated in TABLE III below.

Processing Example 5

Photographic Sample 3 was exposed to the series of neutral and color patches and then developed using Process B. The resulting negative image was scanned and a digital correction factor derived in the manner described in Processing Example 2. For this particular film-process combination there were, as expected, differences in the chemical interactions between the various color records and differences in the film's characteristic curve compared to that of the check position described in Processing Example 2. Equation IV below describes the conversion of digital scanner density representative signals ($R_{SD}$, $G_{SD}$, $B_{SD}$) to digital channel independent representative signals ($R_{CI}$, $G_{CI}$, $B_{CI}$) for this film-process combination.

Equation IV $$\begin{bmatrix} R_{CI} \\ G_{CI} \\ B_{CI} \end{bmatrix} = \begin{bmatrix} 0.900 & 0.101 & -0.001 \\ 0.081 & 1.123 & -0.205 \\ -0.117 & -0.218 & 1.335 \end{bmatrix} \begin{bmatrix} R_{SD} \\ G_{SD} \\ B_{SD} \end{bmatrix}$$

Photographic Sample 3 was also exposed to an additional series of neutral and colored patches, and processed using Process B to form a negative image having cyan, magenta, and yellow dye densities which vary in an imagewise fashion. The resulting negative image was used to make an optical print in such a way that a specific, neutrally exposed, patch produced Status A densities of 0.7±0.03 in all 3 color records. The Status A densities were measured for the set of patches and the differences in the Status A densities of this film-process combination compared to those of the check film-process combination (as described in Processing Example 2) are tabulated in TABLE II.

A digital representation of this negative image was obtained by means of an optoelectronic scanner. The digital scanner density representative signals ($R_{SD}$, $G_{SD}$, $B_{SD}$) were then processed as described above to obtain the digital log exposure representative signals ($R_{LE}$, $G_{LE}$, $B_{LE}$). These signals were then processed through an aim film-paper model to produce an output image having the desired color and tone scale reproduction. This was done in such a way that the selected, neutrally exposed, patch produced a specified set of matched Status A densities. The Status A densities were obtained for the set of patches and the differences in the digitally corrected Status A densities of this film-process combination compared to those of the check film-process combination are tabulated in TABLE III below.

Processing Example 6

Photographic Sample 3 was exposed to the series of neutral and color patches and then developed using Process D. The resulting negative image was scanned and a digital correction factor was derived in the manner described in Processing Example 2. For this particular film-process combination there were, as expected, differences in the chemical interactions between the various color records and differences in the film's characteristic curve compared to that of the check position described in Processing Example 2. Equation V below describes the conversion of digital scanner density representative signals ($R_{SD}$, $G_{SD}$, $B_{SD}$) to digital channel independent representative signals ($R_{CI}$, $G_{CI}$, $B_{CI}$) for this film-process combination.

Equation V $$\begin{bmatrix} R_{CI} \\ G_{CI} \\ B_{CI} \end{bmatrix} = \begin{bmatrix} 0.579 & 0.117 & 0.304 \\ 0.308 & 1.603 & 0.366 \\ -0.052 & -0.192 & 1.244 \end{bmatrix} \begin{bmatrix} R_{SD} \\ G_{SD} \\ B_{SD} \end{bmatrix}$$

Photographic Sample 3 was also exposed to an additional series of neutral and colored patches, and processed using Process D to form a negative image having cyan, magenta, and yellow dye densities which vary in an imagewise fashion. This negative image was used to make an optical print in such a way that a specific, neutrally exposed, patch produced Status A densities of 0.7±0.03 in all 3 color records. The Status A densities were measured for the set of patches and the differences in the Status A densities of this film-process combination compared to those of the check film-processes (as described Processing Example 2) are tabulated in TABLE II below.

A digital representation of this negative image was obtained by means of an optoelectronic scanner. The digital scanner density representative signals ($R_{SD}$, $G_{SD}$, $B_{SD}$) were then processed as described above to obtain the digital log exposure representative signals ($R_{LE}$, $G_{LE}$, $B_{LE}$). These signals were then processed through an aim film-paper model to produce an output image having the desired color and tone scale reproduction. This was done in such a way that the selected, neutrally exposed, patch produced a specified set of matched Status A densities. The Status A densities were obtained for the set of patches and the differences in the digitally corrected Status A densities of this film-process combination compared to those of the check film-process combination are tabulated in TABLE III below.

Processing Example 7

Photographic Sample 4 was exposed to the series of neutral and color patches and developed using Process B. The resulting negative image was scanned and a digital correction factor was derived in the manner described in Processing Example 2. For this particular film-process combination there were, as expected, differences in the chemical interactions between the various color records and differences in the film's characteristic curve compared to that of the check position described in Processing Example 2. Equation VI below describes the conversion of digital scanner density representative signals ($R_{SD}$, $G_{SD}$, $B_{SD}$) to digital channel independent representative signals ($R_{CI}$, $G_{CI}$, $B_{CI}$) for this film-process combination.

Equation VI $$\begin{bmatrix} R_{CI} \\ G_{CI} \\ B_{CI} \end{bmatrix} = \begin{bmatrix} 0.905 & 0.057 & 0.038 \\ 0.071 & 1.850 & 0.079 \\ -0.145 & -0.213 & 1.358 \end{bmatrix} \begin{bmatrix} R_{SD} \\ G_{SD} \\ B_{SD} \end{bmatrix}$$

Photographic Sample 4 was also exposed to an additional series of neutral and colored patches, and then developed using Process B to form a negative image having cyan, magenta, and yellow dye densities which vary in an imagewise fashion. This negative image was used to make an optical print in such a way that a specific, neutrally exposed, patch produced Status A densities of 0.7±0.03 in all 3 color records. The Status A densities were measured for the set of patches and the differences in the Status A densities of this film-process combination compared to those of the check film-process combination (as described in Processing Example 2) are tabulated in TABLE II.

A digital representation of this negative image was obtained by means of an optoelectronic scanner. The digital scanner density representative signals ($R_{SD}$, $G_{SD}$, $B_{SD}$) were then processed as described above to obtain the digital log exposure representative signals ($R_{LE}$, $G_{LE}$, $B_{LE}$). These were then processed through an aim film-paper model to produce an output image having the desired color and tone scale reproduction. This was done in such a way that the selected, neutrally exposed, produced a specified set of matched Status A densities. The Status A densities were obtained for the set of patches and the differences in the digitally corrected Status A densities of this film-process combination compared to those of the check film-process combination are tabulated in TABLE III below.

Processing Example 8

Photographic Sample 5 (Control B) was exposed to the series of neutral and color patches and then developed using Process B. The resulting negative image was scanned and a digital correction factor derived in the manner described in Processing Example 2. For this particular film-process combination there were, as expected, differences in the chemical interactions between the various color records and differences in the film's characteristic curve compared to that of the check position described in Processing Example 2. Equation VII below describes the conversion of digital scanner density representative signals ($R_{SD}$, $G_{SD}$, $B_{SD}$) to digital channel independent representative signals ($R_{CI}$, $G_{CI}$, $B_{CI}$) for this film-process combination.

Equation VII $$\begin{bmatrix} R_{CI} \\ G_{CI} \\ B_{CI} \end{bmatrix} = \begin{bmatrix} 0.812 & 0.048 & 0.140 \\ 0.006 & 0.859 & 0.135 \\ -0.073 & -0.230 & 1.303 \end{bmatrix} \begin{bmatrix} R_{SD} \\ G_{SD} \\ B_{SD} \end{bmatrix}$$

Photographic Sample 5 was also exposed to an additional series of neutral and colored patches, and then processed using Process B to form a negative image having cyan, magenta, and yellow dye densities which vary in an imagewise fashion. This negative image was used to make an optical print in such a way that a specific, neutrally exposed, patch produced Status A densities of 0.7±0.03 in all 3 color records. The Status A densities were measured for the set of patches and the differences in the Status A densities of this film-process combination compared to those of the check film-process combination (as described in Processing Example 2) are tabulated in TABLE II below.

A digital representation of this negative image was obtained by means of an optoelectronic scanner. The digital scanner density representative signals ($R_{SD}$, $G_{SD}$, $B_{SD}$) were then processed as described above to obtain the digital log exposure representative signals ($R_{LE}$, $G_{LE}$, $B_{LE}$). These were then processed through an aim film-paper model to produce an output image having the desired color and tone scale reproduction. This was done in such a way that the selected, neutrally exposed, patch produced a specified set of matched Status A densities. The Status A densities were obtained for the set of patches and the differences in the digitally corrected Status A densities of this film-process combination compared to those of the check film-process combination are tabulated in TABLE III below.

Results of Processing Examples 2–8

TABLE II below shows the calculated sample standard deviations between the Status A densities produced by the optical print of an image taken on the check film and processed in the check processing conditions and the Status A densities produced by the optical print of the image taken on the specified experimental film and processed in the specified experimental processing conditions. The sample standard deviations were calculated for each color record according to the following equations. The sample standard deviations were then averaged to give an indication of the overall differences in color and tone-scale reproduction between the two systems. The average was then calculated using only the neutrally exposed patches, "GS Avg", to give an indication of the tone scale reproduction of the system.

TABLE II $$S_R=\sqrt{\frac{\sum_{1}^{n}(R_C-R_E)^2}{n-1}}$$

$$S_g=\sqrt{\frac{\sum_{1}^{n}(G_C-G_E)^2}{n-1}}$$

$$S_G=\sqrt{\frac{\sum_{1}^{n}(B_C-E_E)^2}{n-1}}$$

| Photographic Sample | Process | Red | Green | Blue | Average | GS Avg |
|---|---|---|---|---|---|---|
| 6 | A | Check | Check | Check | Check | Check |
| 1 | B | 20.4 | 18.3 | 25.0 | 21.2 | 19.8 |
| 2 | B | 20.4 | 18.5 | 25.7 | 21.4 | 18.1 |
| 3 | B | 16.1 | 10.7 | 23.5 | 16.7 | 8.4 |
| 3 | D | 24.6 | 8.5 | 24.5 | 19.2 | 14.4 |
| 4 | B | 8.5 | 8 | 17 | 11 | 6.5 |
| 5 | B | 16.3 | 10.4 | 16 | 14.3 | 14 |

TABLE III below shows the calculated sample standard deviations in Status A densities between the control films and the experimental film-process combinations as described in TABLE II. However, in TABLE III, the Status A densities were obtained from images that had been digitally corrected, as described earlier in Processing Examples 2–8, to improve the color and tone scale reproduction. It can be seen that the digitally corrected data in TABLE III show reduced deviations in Status A densities for the experimental film-process combinations compared to the optical data in TABLE II.

TABLE III

| Photographic Sample | Process | Red | Green | Blue | Average | GS Avg |
|---|---|---|---|---|---|---|
| 6 | A | Check | Check | Check | Check | Check |
| 1 | B | 8 | 8.4 | 8.7 | 8.4 | 2.8 |
| 2 | B | 11 | 8 | 9.6 | 9.5 | 1.6 |
| 3 | B | 15.1 | 16.8 | 9.4 | 13.8 | 1.7 |
| 3 | D | 18.6 | 16.1 | 12.2 | 15.6 | 1.6 |

TABLE III-continued

| Photographic Sample | Process | Red | Green | Blue | Average | GS Avg |
|---|---|---|---|---|---|---|
| 4 | B | 6.8 | 9.9 | 13 | 9.9 | 8.4 |
| 5 | B | 6.7 | 4.5 | 17.7 | 9.6 | 1.9 |

As is readily apparent on examination of the "GS Avg" data presented in TABLE III, the duplitized elements (Photographic Samples 1–3) when processed, digitized and corrected according to the present invention, provide excellent color reproduction. Further, this excellent color reproduction along with extremely rapid photographic processing and high photographic sensitivity can, quite surprisingly, only be achieved by using the photographic elements and processes described herein. The other described elements (Controls A–C) and processes, when employed in combination, each fail to simultaneously provide this combination of useful and highly desired but as yet unachieved results.

Processing Example 9

Visual Confirmation of Improved Color and Sharpness Reproduction

Portions of Photographic Samples 1–5 were slit to a width of 35 μm, perforated and spooled in film cartridges. The cartridges were then individually loaded into a single lens reflex camera and identical comparative pictures of both test objects and human subjects were exposed using a common lens.

Photographic Samples 1–3 were spooled and loaded such that the blue light sensitive layers were farther from the exposure source, that is the lens, than was the support. Photographic Samples 4 and 5 (Controls A and B) were spooled and loaded in the normal manner, that is with all light sensitive layers closer to the exposure source (the lens) than was the support.

Negative images obtained using portions of Photographic Samples 1–5 were individually processed using Processes B, C and D.

In one series of experiments, the negative images formed on each sample after each process were optically printed with an 18% test scene gray patch forced to a neutral print density of about 0.70±0.03.

In another series of experiments, the negative images formed on each sample after each process were scanned, digitized and color corrected according to the present invention. The resulting digitized color corrected images were digitally printed again with the 18% test scene gray patch forced to a common neutral print density.

In all cases, the digitally corrected images were judged to exhibit superior color reproduction relative to the corresponding uncorrected optically printed images, thus visually confirming the benefits of the practice of the present invention.

The sharpness of the images formed in the individual samples using the described processes was visually assessed. The images derived from Photographic Samples 1–3 according to the present invention exhibited improved visual sharpness relative to the corresponding images from Photographic Samples 4 and 5. This was quite surprising since in Photographic Samples 1–3, the blue light sensitive layers were exposed through all of the other light sensitive layers and the support. This latter evaluation thus confirms the benefits of arranging the layer order and spooling of a color photographic element such that a red or green light sensitive layer is closer to an exposure source than are the support and a blue light sensitive layer.

The invention has been described in detail with particular reference to preferred embodiments thereof, but it will be understood that variations and modifications can be effected within the spirit and scope of the invention.

We claim:

1. A method for providing a color display image comprising the steps of:

A) color developing an imagewise exposed light sensitive silver halide color photographic element exhibiting a sensitivity of at least ISO 25, and comprising a support having thereon at least two color recording units, each of said at least two color recording units being sensitive to a distinct region of the electromagnetic spectrum, and comprising at least one silver halide emulsion layer having light sensitive silver halide emulsion grains in reactive association with a compound capable of forming an image dye during a color development step, thereby providing at least two such silver halide emulsion layers sensitive to distinct regions of the electromagnetic spectrum in said element, wherein said support is interposed between two of said silver halide emulsion layers sensitive to distinct regions of the electromagnetic spectrum, with a color developer having a pH of from about 9 to about 12, and comprising a color developing agent at from about 0.01 to about 0.1 mol/l, and bromide ion at up to about 0.5 mol/l, at a temperature at or above about 30° C. for up to about 4 minutes, to provide a developed image, B) scanning said developed image to form density representative digital signals for said at least two color recording units, and C) digitally manipulating said density representative digital signals formed in step B to correct either or both interimage interactions and gamma mismatches among said at least two color recording units so as to produce a digital record of a corrected color image.

2. The method of claim 1 wherein said digital record is transmitted to an output device.

3. The method of claim 2 wherein said digital record is transmitted to an output display device.

4. The method of claim 1 wherein said developed element is at least partially desilvered before scanning step B.

5. The method of claim 1 wherein said developed element is at least partially fixed before scanning step B.

6. The method of claim 1 wherein said element has at least three color recording units.

7. The method of claim 1 wherein said color developer solution pH is from about 9.5 to about 11.

8. The method of claim 1 wherein said color developing agent is present in said color developer solution in an amount of from about 0.02 to about 0.06 mol/l.

9. The method of claim 1 wherein said bromide ion is present in said color developer solution in an amount of from about 0.0001 to about 0.1 mol/l.

10. The method of claim 1 wherein said developing step is carried out for from about 5 to about 120 seconds.

11. The method of claim 1 wherein said developing step is carried out at from about 37° to about 65° C.

12. The method of claim 1 wherein said color developing solution further comprises a hydroxylamine or hydroxylamine derivative as an antioxidant in an amount of at least about 0.001 mol/l.

13. The method of claim 12 wherein said antioxidant is chosen from the group consisting of: N-isopropyl-N-(2-ethanesulfonic acid)hydroxylamine, N,N-bis(propionic acid)hydroxylamine, N,N-bis(2-ethanesulfonic acid) hydroxylamine, N-isopropyl-N-(n-propylsulfonic acid) hydroxylamine, N-2-ethanephosphonic acid-N-(propionic acid)hydroxylamine, N,N-bis(2-ethanephosphonic acid) hydroxylamine, N-sec-butyl-N-(2-ethanesulfonic acid) hydroxylamine, N,N-bis(sec-butylcarboxylic acid) hydroxylamine, N-methyl-N-(p-carboxylbenzyl) hydroxylamine, N-isopropyl-N-(p-carboxylbenzyl) hydroxylamine, N,N-bis(p-carboxylbenzyl)hydroxylamine, N-methyl-N-(p-carboxyl-m-methylbenzyl)hydroxylamine, N-isopropyl-N-(p-sulfobenzyl)hydroxylamine, N-ethyl-N-p-phosphonobenzyl)hydroxylamine, N-isopropyl-N-(2-carboxymethylene-3-propionic acid)hydroxylamine, N-isopropyl-N-(2-carboxyethyl)hydroxylamine, and N-isopropyl-N-(2,3-dihydroxypropyl)hydroxylamine, and alkali metal salts thereof.

14. The method of claim 1 wherein said silver halide element comprises at least one emulsion layer having 50 mol % chloride based on total silver.

15. The method of claim 1 wherein said silver halide element comprises at least one emulsion layer having 50 mol % bromide based on total silver.

16. The method of claim 1 wherein said silver halide element comprises at least one emulsion layer having up to about 6 mol % iodide based on total silver.

17. The method of claim 1 wherein said color developer comprises chloride ions.

18. The method of claim 1 wherein said digital record is used to provide a display material that is a color print, a color slide, a motion picture print, an advertising display print, or an advertising display transparency.

19. The method of claim 1 wherein said element comprises: a) at least one of a red light sensitive recording unit and a green light sensitive recording unit, and b) a blue light sensitive recording unit.

20. The method of claim 1 wherein each of said color recording units comprises an image dye-forming coupler that forms dye on reaction with an oxidized form of a p-phenylene diamine color developing agent.

21. The method of claim 19 wherein at least one green light sensitive color layer and at least one red light sensitive color layer are disposed on one side of said support, and at least one blue light sensitive color layer is disposed on the opposite side of said support.

22. The method of claim 1 wherein said element comprises a tabular grain silver halide emulsion having an average aspect ratio greater than about 2.

23. The method of claim 19 wherein said red light sensitive layer or said green light sensitive layer comprises a silver halide emulsion with a content of greater than about 50 mol % silver chloride, and said blue light sensitive layer comprises a silver halide emulsion having at least 50 mol % silver bromide.

24. The method of claim 1 wherein said element comprises a silver halide emulsion with a content greater than about 50 mol % silver chloride, and in which at least 50% of the grain projected area is accounted for by tabular grains having an aspect ratio of greater than 2 and having {100} or {111} major faces.

25. The method of claim 19 wherein said blue light sensitive color recording unit comprises a silver halide emulsion with a silver iodide content of greater than about 0.5 mol % silver iodide.

26. The method of claim 19 wherein the coated layer thickness on either side of said support is up to about 30 μm.

27. The method of claim 19 wherein said element comprises up to about 0.2 mmol/m$^2$ of an incorporated permanent Dmin adjusting dye.

28. The method of claim 1 wherein said element comprises up to 0.6 mmol/m$^2$ of a color masking coupler.

29. The method of claim 1 wherein said support is substantially transparent, and has a thickness of up to about 150 μm.

30. The method of claim 19 wherein said red or green light sensitive color recording unit comprises an emulsion having at least 50 mol % silver chloride, and said blue light sensitive color recording unit comprises an emulsion having at least 50 mol % silver bromide.

31. The method of claim 1 further comprising the step of:

displaying said digital record on a screen, digitally writing said digital record to a viewable medium, digitally transmitting said digital record electronically, storing said digital record in digital form, storing said digital record in analog form, or digitally writing said digital record to a silver halide display element.

32. The method of claim 1 wherein said at least one silver halide emulsion is a tabular silver halide emulsion having an average aspect ratio of at least 2 and is bounded by predominantly {100} major faces.

33. The method of claim 1 wherein at least one silver halide emulsion is a tabular silver halide emulsion having an average aspect ratio of at least 2 and is bounded by predominantly {111} major faces.

34. The method of claim 1 wherein said element comprises at least 50 mol % silver bromide based on silver and wherein said developer solution comprises at least 0.003 mol/l bromide ion.

35. The method of claim 1 wherein said support further comprises a magnetic recording layer.

36. A method for providing a color display image comprising the steps of:

A) color developing an imagewise exposed and light sensitive silver halide color photographic element exhibiting a sensitivity of at least ISO 25, and comprising a support having thereon at least two color recording units, each of said at least two color recording units being sensitive to a distinct region of the electromagnetic spectrum, and each comprising at least one silver halide emulsion layer having light sensitive silver halide emulsion grains in reactive association with a compound capable of forming an image dye during a color development step, thereby providing at least two such silver halide emulsion layers sensitive to distinct regions of the electromagnetic spectrum in said element, wherein said support is a flexible support that is substantially transparent after color photographic processing and that is interposed between two of said silver halide emulsion layers sensitive to distinct regions of the electromagnetic spectrum, and wherein said element has:

a coated layer(s) thickness of up to about 30 μm on either side of said support, up to about 0.2 mmol/m$^2$ of incorporated permanent Dmin adjusting dye, and up to about 0.6 mmol/m$^2$ of color masking coupler, with a color developer having a pH of from about 9 to about 12, and comprising a color developing agent at from about 0.02 to 0.06 mol/l, and bromide ion at from about 0.0001 to about 0.1 mol/l, said color developing being carried out at a temperature at or above about 37° C., to provide a developed image, B) scanning said developed image to form density representative digital signals for said at least two color records, and C) digitally manipulating said density representative digital signals formed in step B to correct either or both interimage interactions and gamma mismatches among said at least two color records so as to produce a digital record of a corrected color image.

37. The method of claim 36 wherein said silver halide element comprises a red light sensitive color recording unit having a peak spectral sensitivity between about 700 and 600 nm, a green light sensitive color recording unit having a peak spectral sensitivity between about 600 and 500 nm, and a blue light sensitive color recording unit having a peak spectral sensitivity between about 500 and 400 nm.

* * * * *